US007474302B2

(12) United States Patent
Iisaka

(10) Patent No.: US 7,474,302 B2
(45) **Date of Patent: *Jan. 6, 2009**

(54) ELECTRO-OPTICAL DEVICE, DRIVING METHOD OF ELECTRO-OPTICAL DEVICE, DRIVING CIRCUIT OF ELECTRO-OPTICAL DEVICE AND ELECTRONIC APPARATUS

(75) Inventor: Hidehito Iisaka, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 654 days.

This patent is subject to a terminal disclaimer.

(21) Appl. No.: 11/043,471

(22) Filed: Jan. 27, 2005

(65) Prior Publication Data

US 2005/0195148 A1 Sep. 8, 2005

(30) Foreign Application Priority Data

Feb. 12, 2004 (JP) ..... 2004-035087

(51) Int. Cl.
*G09G 5/00* (2006.01)

(52) U.S. Cl. ..... 345/204; 345/89; 345/98; 345/99; 345/212; 345/213; 345/690

(58) Field of Classification Search ..... 345/87–100, 345/204–215, 690–698
See application file for complete search history.

(56) References Cited

U.S. PATENT DOCUMENTS

| | | | | |
|---|---|---|---|---|
| 7,084,862 | B2 | 8/2006 | Matsumoto | |
| 7,352,348 | B2 * | 4/2008 | Hosaka et al. | 345/89 |
| 2005/0179679 | A1 * | 8/2005 | Hosaka et al. | 345/204 |
| 2007/0085805 | A1 * | 4/2007 | Ishii et al. | 345/98 |

FOREIGN PATENT DOCUMENTS

| | | |
|---|---|---|
| JP | A 5-313608 | 11/1993 |
| JP | A-08-322024 | 12/1996 |
| KR | 2003-0040143 | 5/2003 |

OTHER PUBLICATIONS

U.S. Appl. No. 10/667,340, filed Sep. 28, 2003, Iisaka.

* cited by examiner

*Primary Examiner*—Vijay Shankar
(74) *Attorney, Agent, or Firm*—Oliff & Berridge, PLC

(57) ABSTRACT

A driving circuit of an electro-optical device that can reduce or prevent bad influences of a transverse electric field and a crosstalk is provided. There can also be provided a driving circuit of an electro-optical device, the driving circuit generating timing signals for supplying scanning signals to a display unit in which pixels can be formed corresponding to the respective intersections between a plurality of data lines and a plurality of scanning lines arranged in a matrix shape and the switching elements provided in the pixels are turned on by the scanning signals supplied to the scanning lines, so that the image signal supplied to the data lines are applied to the pixel electrodes of the pixels through the switching elements to drive the display unit.

9 Claims, 15 Drawing Sheets

ELECTRO-OPTICAL DEVICE, DRIVING METHOD OF ELECTRO-OPTICAL DEVICE, DRIVING CIRCUIT OF ELECTRO-OPTICAL DEVICE AND ELECTRONIC APPARATUS

BACKGROUND OF THE INVENTION

1. Field of the Invention

Aspects of the invention can relate to an electro-optical device with a reduced cross-talk, a driving method of the electro-optical device, a driving circuit of the electro-optical device, and an electronic apparatus.

2. Description of Related Art

Related art liquid crystal display devices using a liquid crystal as an electro-optical material, which are an example of electro-optical devices, have been widely used, as display devices taking the place of cathode ray tubes (CRT), for display units of various data processing instruments, liquid crystal televisions, and the like.

Such related art liquid crystal display devices can include an element substrate provided with pixel electrodes arranged in a matrix shape and switching elements, such as TFT (Thin Film Transistors) connected to the pixel electrode, a counter substrate on which a counter electrode opposing the pixel electrodes is formed, and a liquid crystal as an electro-optical material filled between both substrates.

The TFT is turned on by scanning signals (gate signals) supplied through scanning lines (gate lines). In a state where the switching elements are turned on by application of the scanning signals, image signals of voltages corresponding to gray scales are supplied to the pixel electrodes through data lines. Then, electric charges corresponding to the voltages of the image signals are accumulated in the pixel electrodes and the counter electrode. Even when the scanning signals are removed and the TFT is turned off after accumulation of the electric charges, the accumulated state of electric charges in the electrodes is maintained by the capacitance of a liquid crystal layer or storage capacitors. In this way, when the switching elements are driven to control the electric charges to be accumulated in accordance with the gray scale, the alignment state of the liquid crystal is varied every pixel, the light transmittance is changed, and thus the brightness can be changed every pixel. Accordingly, the gray-scale display is possible.

However, in the liquid crystal display device, for example, decomposition of liquid crystal components and contamination due to impurities in liquid crystal cells occur by application of a DC component of the applied signal, so that phenomena such as blots of a displayed image take place. Therefore, an inversion driving method of inverting the polarity of the driving voltage of the pixel electrodes, for example, in a unit of frames of the image signal is performed in general. A surface inversion driving method is a method of inverting the polarity of the driving voltage at a constant cycle in a state where the driving voltages of the entire pixel electrodes constituting an image display area are set to the same polarity in a screen.

Considering the capacitances of the liquid crystal layer and the storage capacitors, the application of electric charges to the liquid crystal layer of each pixel may be performed only during a partial period. Therefore, when a plurality of pixels arranged in a matrix shape is driven, a scanning signal is simultaneously applied to the pixels connected the same scanning line through the scanning line, an image signal is supplied to the pixels through the data lines, and the scanning lines supplying the image signal are sequentially shifted. That is, in the liquid crystal display device, when the scanning lines and the data lines are common to a plurality of pixels, a divisional multiplex driving method is possible.

In this way, in the liquid crystal display device, the driving voltage can be applied to the pixels only in a partial period in consideration of the capacitance. However, the potentials of the data lines have an influence on the pixel electrodes due to the combined capacitance and the leakage of electric charges even during the period when the TFT is turned off. The potential variation of the applied voltages to the pixels makes the display in a screen irregular and particularly makes the deterioration of image quality visible in intermediate gray-scale areas.

Therefore, in order to prevent such problems, in the liquid crystal display device, an inversion driving method, which combines, for example, a line inversion driving method changing the polarity of the driving potential in a unit of lines with an inversion driving method in a unit of frames, is employed. By changing the polarities of the image signals transmitted through the data lines for a relatively short time, influences of the combined capacitance and the leakage of electrical charges can be reduced.

However, in the line inversion driving operation, an electric field (hereinafter, referred to as a transverse electric field) between pixel electrodes adjacent to each other in the column direction or the row direction, in which voltages having different polarities are applied, on the same substrate is generated. Further, in a dot inversion driving method of changing the polarities of the driving voltages in a unit of dots, a transverse electric field is generated between the pixel electrodes adjacent to each other in the column direction and the row direction in which voltages having different polarities are applied.

When such a transverse electric field is generated between the adjacent pixel electrodes, one edge side portion of each pixel electrode is influenced by the transverse electric field, so that the inclination direction of the liquid crystal molecules can be easily different from that of other liquid crystal molecules. Due to the disturbance in alignment (disclination) of the liquid crystal molecules, a stripe shape (stripe blur) appears along the portion having the defective alignment. That is, light leakage occurs in the disclination area, and when the disclination area is made to be a non-open area, the aperture ratio is reduced.

Japanese Unexamined Patent Application Publication No. 5-313608 suggests, as a technique for preventing the disclination due to the transverse electric field and securing uniformity of an image, a technology that one horizontal period is divided into a first period and a second period, the image signal is applied to the pixel electrodes during the first period by supplying the driving pulse to the scanning lines and supplying the image signal to the data lines, and the image signal having a polarity opposite to the previous one is supplied to the data lines without supplying the driving pulse to the scanning lines during the second period. However, in this technology, there is a problem that the time period which can be used for the pixel writing becomes a half a normal time period, thereby causing the insufficient writing.

SUMMARY OF THE INVENTION

Aspects of the invention provide a driving method of performing the writing operation of different polarities by driving two scanning lines corresponding to, for example, two different lines during one horizontal period. However, in this driving method, when the number of horizontal scanning lines in one horizontal period is odd or not an integer, the writing time is insufficient at the time of changing the vertical period, thereby deteriorating a display image.

An aspect of the invention can provide an electro-optical device capable of securing uniformity of display quality in a screen, suppressing occurrence of disclination, and preventing problems such as insufficient writing from occurring, a driving method of the electro-optical device, a driving circuit of the electro-optical device, and an electronic apparatus employing the electro-optical device.

According to an aspect of the present invention, there is provided a driving circuit of an electro-optical device, the driving circuit including a transmission clock generator generating a transmission clock for sequentially transmitting the scanning signals to the scanning lines in synchronism with a signal having a frequency equal to a horizontal frequency of input image signals and outputting the transmission clock as a timing signal, a vertical reset signal generator generating a vertical reset signal synchronized with the transmission clock generated in close proximity of a vertical synchronizing signal of the input image signals; a scanning start pulse generator generating a scanning start pulse defining a start timing of a vertical scanning operation on the basis of the transmission clock and the vertical reset signal and outputting the scanning start pulse as a timing signal; and a writing image generator generating writing image signals to be supplied to the data lines by delaying the input image signals on the basis of the transmission clock and the vertical reset signal.

According to this structure, the pixels are formed corresponding to the respective intersections between a plurality of data lines and a plurality of scanning lines arranged in a matrix shape, and the switching elements provided in the pixels are turned on by the scanning signals supplied to the scanning lines, so that the image signal supplied to the data lines are applied to the pixel electrodes of the pixels through the switching elements to drive an electro-optical material. Accordingly, the display unit of the electro-optical device can be driven. The scanning signals are generated on the basis of the timing signals. The transmission clock, which is one of the timing signals, is generated in synchronism with the signal having a frequency equal to the horizontal frequency of the input image signals. The vertical reset signal is generated in close proximity of the vertical synchronizing signal of the input image, and is synchronized with the transmission clock. The scanning start pulse is generated on the basis of the transmission clock and the vertical reset signal. That is, since the timing signals for performing the vertical scanning operation are generated on the basis of the independent transmission clock, the cycle of the transmission clock is not varied before and after the start timing of the vertical period, so that it is possible to continuously and constantly write the writing image for a sufficient writing time, even when the number of horizontal periods in one vertical period is not an integer or when the number of horizontal scanning lines in one vertical period is odd.

According to another aspect of the invention, there can be provided an electro-optical device including the driving circuit of an electro-optical device, a scanning drive circuit generating the scanning signals on the basis of the outputs of the transmission clock generator and the scanning start pulse generator, a data drive circuit supplying the writing image signals from the writing image generator to the data lines, and the display unit.

According to this structure, the scanning drive circuit generates the scanning signals on the basis of the outputs of the transmission clock generator and the scanning start pulse generator. Accordingly, the scanning operation in the display unit is synchronized with the independent transmission clock, so that it is possible to obtain a sufficient writing time before and after the start timing of the vertical period and to continuously and constantly write the writing image.

According to another aspect of the present invention, there can be provided an electro-optical device including pixels formed corresponding to respective intersections between a plurality of data lines and a plurality of scanning lines to constitute a display unit, switching elements which are turned on by scanning signals supplied to the scanning lines and which are provided in the pixels, pixel electrodes in the pixels to which image signals supplied to the data lines are applied through the switching elements when the switching elements are turned on, a scanning drive circuit selecting n scanning lines (n is an integer greater than or equal to 2) spaced from each other to sequentially supply gate pulses to the selected scanning lines in one horizontal period of an input image corresponding to the number of pixels in the display unit and shifting the selected n scanning lines by one line in a next horizontal period, and a timing signal generator generating a transmission clock synchronized with a signal having a frequency equal to a horizontal frequency of the input image, re-timing a vertical synchronizing signal of the input image on the basis of the generated transmission signal to generate a vertical reset signal, and generating timing signals for generating the scanning signals on the basis of the vertical reset signal and the transmission clock to apply the timing signals to the scanning drive circuit. The electro-optical device can further include a writing image generator synthesizing image signals of the input image and delayed signal thereof, arranging the synthesized image having a horizontal frequency, which is n times the horizontal frequency of the input image, in a signal arrangement corresponding to the scanning operation of the scanning drive circuit, and delaying the arranged synthesized image on the basis of the vertical reset signal and the transmission clock to generate a writing image, and a data drive circuit to which image signals of the writing image from the writing image generator are input and which inverts the polarity of the image signals in a unit of a horizontal writing period, which is 1/n times the horizontal period of the input image to supply the inverted image signals to the data lines.

According to the above construction, in the display unit, the pixels can be formed corresponding to the respective intersections between a plurality of data lines and a plurality of scanning lines arranged in a matrix shape, and the switching elements provided in the pixels are turned on by the scanning signals supplied to the scanning lines, so that the image signals supplied to the data lines are applied to the pixel electrodes of the pixels through the switching elements to drive an electro-optical material. The timing signal generator generates the transmission clock synchronized with a signal having a frequency equal to a horizontal frequency of the input image, re-times a vertical synchronizing signal of the input image on the basis of the generated transmission signal to generate the vertical reset signal, and generates the timing signals for generating the scanning signals on the basis of the vertical reset signal and the transmission clock. That is, the timing signals are synchronized with the independent transmission clock. The writing image generator synthesizes the image signals of the input image and delayed signals thereof, arranges the synthesized image having a horizontal frequency, which is n times the horizontal frequency of the input image, in a signal arrangement corresponding to the scanning operation of the scanning drive circuit, and delays the arranged synthesized image on the basis of the vertical reset signal and the transmission clock to generate the writing image. The image signals supplied to the data lines are image signals of the writing image having the horizontal frequency which is n times the horizontal frequency of the input image, and the polarities thereof are inverted in a unit of a horizontal writing period which is 1/n times of the horizontal period of the input image by the data drive circuit.

The scanning drive circuit selects n scanning lines (n is an integer greater than or equal to 2) spaced from each other to sequentially supply gate pulses to the selected scanning lines in one horizontal period of an input image corresponding to the number of pixels in the display unit, and shifts the selected n scanning lines by one line in a next horizontal period. Accordingly, the most adjacent lines are driven with the image signals having the same polarity, so that it is possible to prevent a transverse electric field at the time of the surface inversion driving. As a result, it is possible to secure a uniform display quality in a screen and to prevent or reduce the occurrence of disclination. Since the timing of performing the vertical scanning operation is controlled by the independent transmission clock, the cycle of the transmission clock is not varied before and after the start timing of the vertical period, so that it is possible to continuously and constantly write the writing image for a sufficient writing time, even when the number of horizontal periods in one vertical period is not an integer or when the number of horizontal scanning lines in one vertical period is odd.

The timing signal generator can include a transmission clock generator generating a transmission clock for sequentially transmitting the scanning signals to the scanning lines in synchronism with a signal having a frequency equal to a horizontal frequency of input image signals and outputting the transmission clock as the timing signal, a vertical reset signal generator generating a vertical reset signal synchronized with the transmission clock generated in close proximity of a vertical synchronizing signal of the input image signals, and a scanning start pulse generator generating a scanning start pulse defining a start timing of a vertical scanning operation on the basis of the transmission clock and the vertical reset signal and outputting the scanning start pulse as a timing signal.

According to this structure, the transmission clock is generated in synchronism with the signal having a frequency equal to the horizontal frequency of the input image signals. The vertical reset signal is generated in synchronism with the transmission clock, and the scanning start pulse for controlling the start timing of the vertical scanning operation is generated on the basis of the transmission clock and the vertical reset signal. That is, the timing signals for the vertical scanning operation are synchronized with the independent transmission clock. As a result, the cycle of the transmission clock is not varied before and after the start timing of the vertical period, so that it is possible to continuously and constantly write the writing image for a sufficient writing time, even when the number of horizontal periods in one vertical period is not an integer or when the number of horizontal scanning lines in one vertical period is odd.

The transmission clock may be generated on the basis of a dot clock. According to this structure, it is possible to generate the independent transmission clock synchronized with the signal having a frequency equal to the horizontal frequency of the input image signals with high accuracy.

According to another aspect of the invention, there can be provided a driving method of an electro-optical device, the electro-optical device including pixels formed corresponding to respective intersections between a plurality of data lines and a plurality of scanning lines to constitute a display units, switching elements which are turned on by scanning signals supplied to the scanning lines and which are provided in the pixels, and pixel electrodes in the pixels to which image signals supplied to the data lines are applied through the switching elements when the switching elements are turned on. The method can include a scan driving process of, for the display unit, selecting n scanning lines (n is an integer greater than or equal to 2) spaced from each other to sequentially supply gate pulses to the selected scanning lines in one horizontal period of an input image corresponding to the number of pixels in the display unit and shifting the selected n scanning lines by one line in a next horizontal period, a timing signal generating process of generating a transmission clock synchronized with a signal having a frequency equal to a horizontal frequency of the input image, re-timing a vertical synchronizing signal of the input image on the basis of the generated transmission signal to generate a vertical reset signal, and generating timing signals for generating the scanning signals on the basis of the vertical reset signal and the transmission clock, a writing image generating process of synthesizing image signals of the input image and delayed signal thereof, arranging the synthesized image having a horizontal frequency, which is n times the horizontal frequency of the input image, in a signal arrangement corresponding to the scanning operation in the scan driving process, and delaying the arranged synthesized image on the basis of the vertical reset signal and the transmission clock to generate a writing image, and a data driving process of receiving image signals of the writing image obtained from the writing image generating process and inverting the polarity of the image signals in a unit of a horizontal writing period, which is 1/n times the horizontal period of the input image to supply the inverted image signals to the data lines.

According to this structure, through the timing signal generating process, the timing signals which are a basis of the vertical scanning operation are synchronized with the transmission clock generated in synchronism with the signal having a frequency equal to a horizontal frequency of the input image. Through the writing image generating process, image signals of the input image and delayed signals thereof are synthesized, the synthesized image having a horizontal frequency, which is n times the horizontal frequency of the input image, is arranged in a signal arrangement corresponding to the scanning operation in the scan driving process to acquire the wring image, and the writing image is delayed on the basis of the vertical reset signal and the transmission clock. Accordingly, the timing of the vertical scanning operation and the timing of the writing operation of the writing image can be matched with each other. The image signals of the writing image are inverted in polarity in a unit of one horizontal writing period. Through the scanning drive process, plural scanning lines are selected and supplied with the gate pulses in one horizontal period. In addition, through the scanning drive process, the selected scanning lines are all shifted by one line in one next scanning period. Accordingly, it is possible to write the writing image signals having the same polarity to the pixels of the adjacent lines. Since the vertical scanning operation is synchronized with the transmission clock, the cycle of the transmission clock is not varied before and after the start timing of the vertical period, so that it is possible to continuously and constantly write the writing image for a sufficient writing time, even when the number of horizontal periods in one vertical period is not an integer or when the number of horizontal scanning lines in one vertical period is odd.

According to another aspect of the invention, there is also provided an electronic apparatus including the electro-optical device described above. According to this structure, it is possible to obtain high-quality images without bad influences of the transverse electric field and the crosstalk.

BRIEF DESCRIPTION OF THE DRAWINGS

The invention will be described with reference to the accompanying drawings, wherein like numerals reference like elements, and wherein.

DETAILED DESCRIPTION OF EMBODIMENTS

Figure 1:
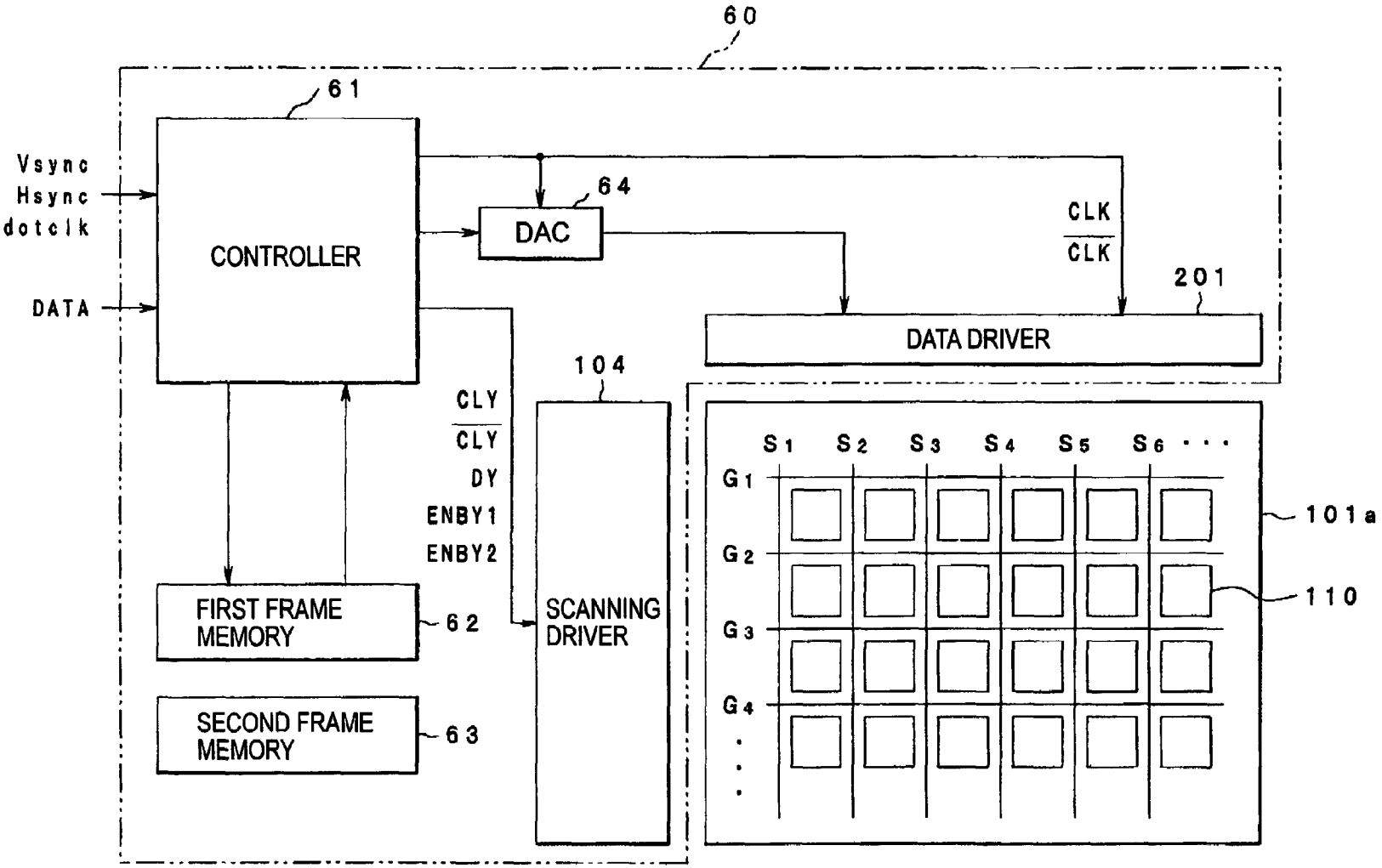
FIG. 1 is an exemplary block diagram illustrating an electro-optical device according to an exemplary embodiment of the invention.

Now, exemplary embodiments of the invention will be described in detail with reference to the drawings. FIGS. 1 to 16 illustrate an exemplary embodiment of the invention. In the drawings, in order to recognize respective layers or respective members from the drawings, the respective layers or the respective members have different scales.

In the exemplary embodiment, an example where the invention is applied to a liquid crystal light valve used as a light modulating device of a projection display apparatus is described.

The electro-optical device according to the embodiment can include a display area 101*a* employing a liquid crystal as an electro-optical material, a scanning driver 104 and a data driver 201 for driving the pixels in the display area 101*a*, a controller 61 for supplying various signals to the scanning driver 104 and the data driver 201, a DC converter (DAC) 64, and first and second frame memory 62 and 63.

Figure 2:
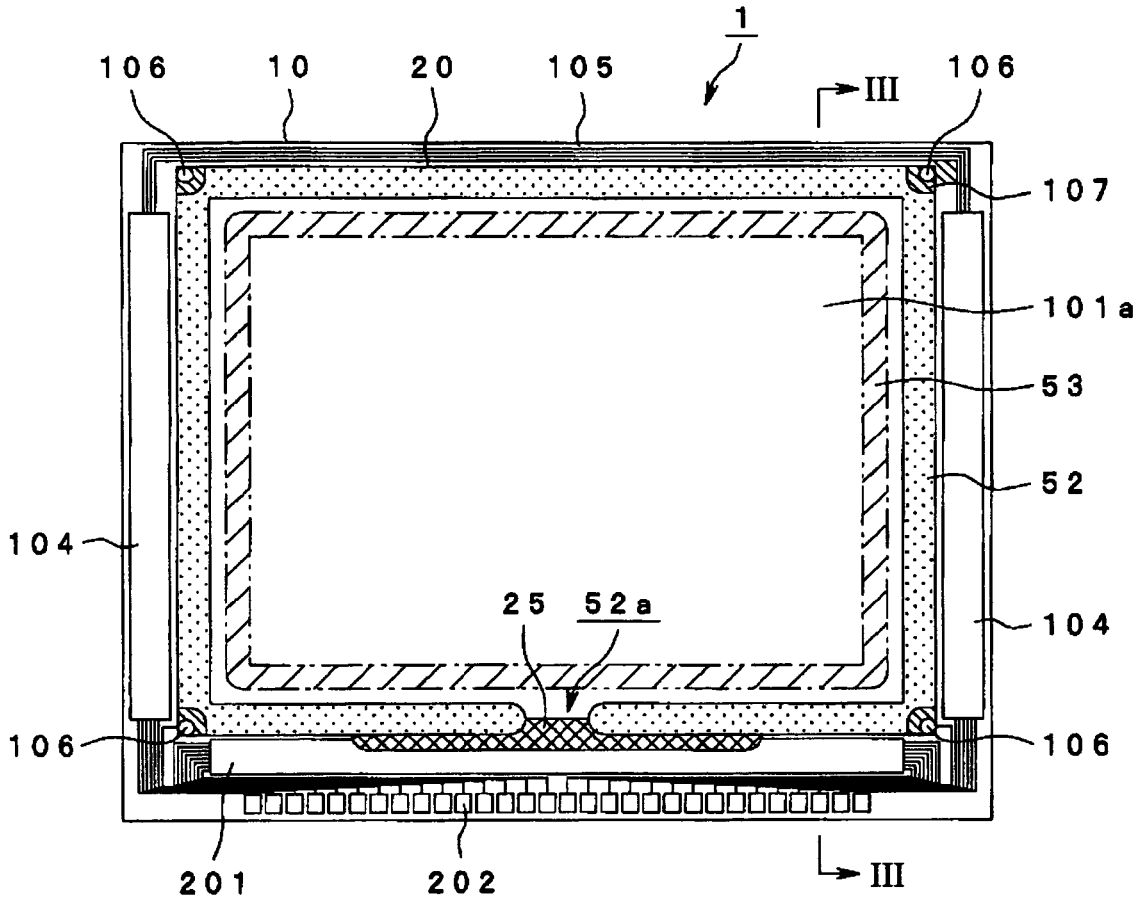
FIG. 2 is a diagram schematically illustrating a structure of a liquid crystal panel employed in the electro-optical device according to the exemplary embodiment.
Figure 3:
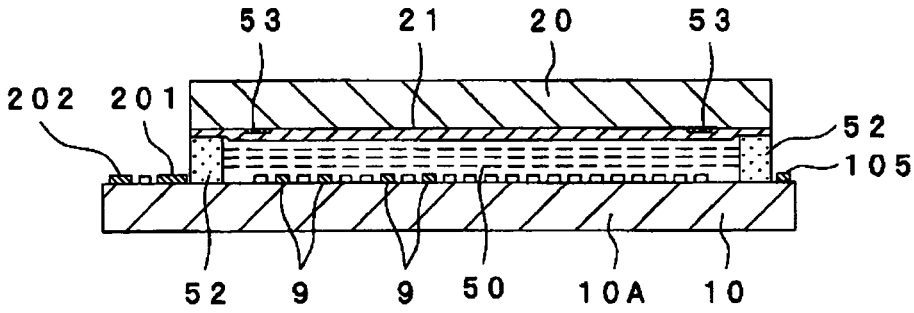
FIG. 3 is a cross-sectional view taken along Line H-H' of FIG. 2.

FIG. 2 show a schematic structure of a liquid crystal panel 1 including the display area 101*a*, the scanning driver 104, and the data driver 201, and FIG. 3 shows a cross-section thereof.

The display area 101*a* is formed at the center of the liquid crystal panel 1. In the display area 101*a*, a transparent substrate, such as a glass substrate, is used as the element substrate, and peripheral driving circuits are also formed on the element substrate, together with the TFTs driving the pixels. In the display area 101*a* on the element substrate, a plurality of gate lines (scanning lines) G1, G2, . . . is formed to extend in the X direction (row direction) of FIG. 1 and a plurality of data lines S1, S2, . . . is formed to extend in the Y direction (column direction). The respective pixels 110 are formed corresponding to respective intersections between the scanning lines and the data lines, and are arranged in a matrix shape.

The display area 101*a* can have 1044×780 pixels including dummy pixels in addition to 1024×768 effective pixels in accordance with, for example, an XGA standard.

As shown in FIGS. 2 and 3, the liquid crystal panel has a structure where a liquid crystal 50 is injected and sealed between a TFT substrate 10 made of, for example, a quartz substrate, a glass substrate, a silicon substrate, etc. and a counter substrate 20 made of, for example, a glass substrate, a quartz substrate, etc. and disposed to oppose the TFT substrate. The TFT substrate 10 and the counter substrate 20 opposing each other are bonded with a seal member 52.

Pixel electrodes (ITO) 9 constituting pixels 110 can be arranged in a matrix shape on the TFT substrate 10. A counter electrode (ITO) 21 covering the whole surface is formed on the counter substrate 20. An alignment film (not shown) having been subjected to a rubbing process is formed on the pixel electrodes 9 of the TFT substrate 10. On the other hand, an alignment film (not shown) having been subjected to a rubbing process is formed on the counter electrode 21 formed on the whole surface of the counter substrate 20. The alignment films are made of a transparent organic film such as a polyimide film.

Figure 4:
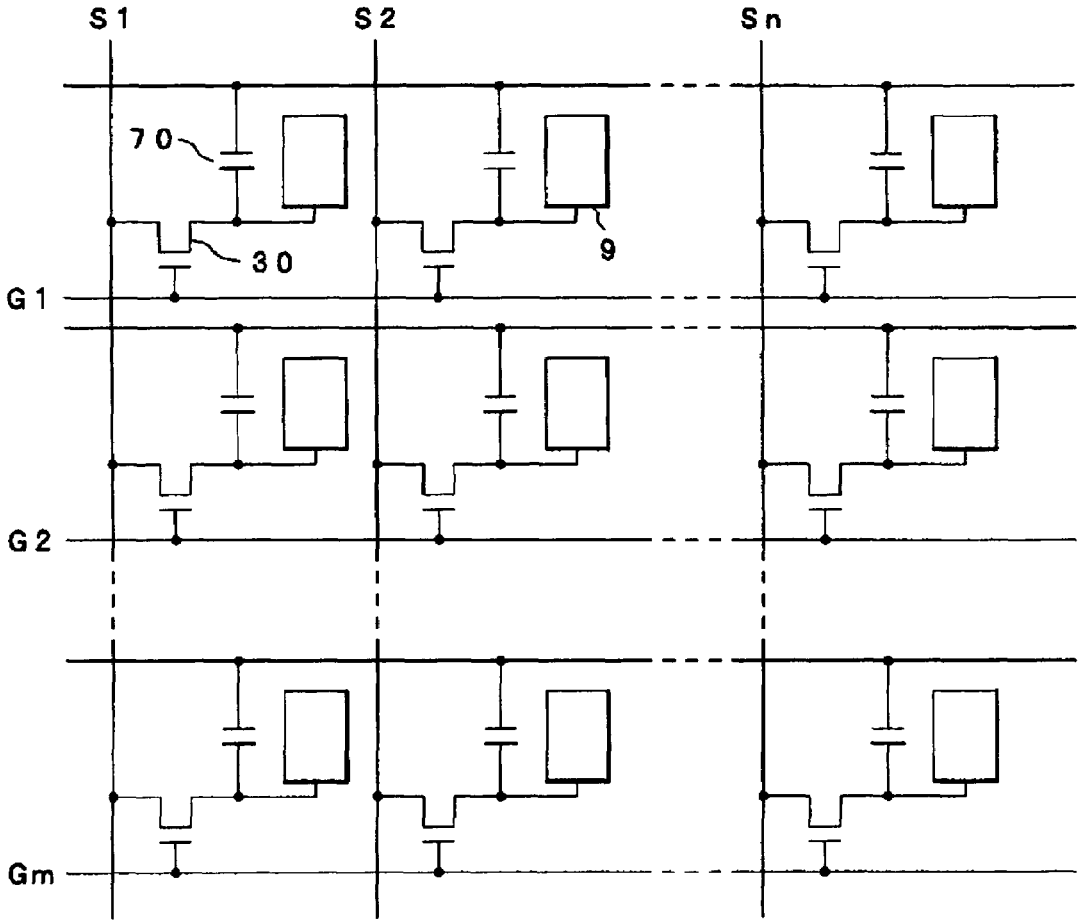
FIG. 4 is an equivalent circuit diagram of plural pixels formed in a matrix shape in a pixel area of the liquid crystal panel.

FIG. 4 is an equivalent circuit of the elements constituting the pixels on the TFT substrate 10. As shown in FIG. 4, in the display area 101*a*, a plurality of scanning lines G1, G2, . . . and a plurality of data lines S1, S2, . . . are arranged to intersect each other, and the pixel electrodes 9 are disposed at the positions defined by the scanning lines G1, G2, . . . and the data lines S1, S2, . . . to form a matrix shape. TFTs 30 as switching elements are provided correspondingly to the respective intersections between the scanning lines G1, G2, . . . and the data lines S1, S2, . . . , and the pixel electrodes 9 are connected to the TFTs 30, respectively.

In the TFT 30 constituting each pixel 110, the gate thereof is connected to the scanning line G1, G2, . . . , the source thereof is connected to the data line S1, S2, . . . , and the drain thereof is connected to the pixel electrode 9. The liquid crystal 50 as an electro-optical material is injected and retained between the pixel electrodes 9 and the counter electrode 21, thereby forming a liquid crystal layer.

The scanning lines G1, G2, . . . are supplied with scanning signals G1, G2, . . . Gm from a scanning driver 104 to be described below. A counter voltage is applied to the counter electrode 21. The scanning signals simultaneously turn on all the TFTs 30 constituting a line in a unit of lines, and thus image signals (image signals of a writing image) supplied to the data lines S1, S2, . . . from a data driver 201 to be described below are written to the pixel electrodes 9. The alignment state of molecule sets of the liquid crystal 50 varies in accordance with the potential difference between the counter electrode 21 and the pixel electrodes 9 to which the image signals are written, so that the modulation of light is performed to enable the gray-scale display.

Storage capacitors 70 are provided in parallel to the pixel electrodes 9, and the voltages of the pixel electrodes 9 can be retained by the storage capacitors 70 for a time longer, for example, by a number of three ciphers than the time when a source voltage is applied. A voltage retaining characteristic can be improved by the storage capacitors 70, so that it is possible to display an image having a high contrast ratio.

As shown in FIGS. 2 and 3, a light-shielding film 53 as a frame defining the display area is provided on the counter substrate 20. In an area outside the light-shielding film 53, the seal member 52 for sealing the liquid crystal is formed between the TFT substrate 10 and the counter substrate 20. The seal member 52 bonds the TFT substrate 10 and the counter substrate 20 to each other to approximately correspond to the outline of the counter substrate 20. The seal member 52 is omitted in a part of a side of the TFT substrate 10 and a liquid crystal injecting port 52*a* for injecting the liquid crystal 50 is formed in the omitted part. The liquid crystal is injected to a gap between the element substrate 10 and the counter substrate 20 bonded to each other through the liquid crystal injecting portion 52*a*. After injecting the liquid crystal, the liquid crystal injecting port 52*a* is blocked up with a sealing material 25.

In the area outside the seal member 52, a data driver 201 driving the data lines S1, S2, . . . by supplying the image signals to the data lines S1, S2, . . . at a predetermined timing, and external connection terminals 202 for connection to external circuits are provided along one side of the TFT 30 substrate 10. Scanning drivers 104 driving the gate electrodes by supplying the scanning signals to the gate electrodes not shown through the scanning lines G1, G2, . . . at a predetermined timing are provided along two sides adjacent to the one side. The scanning drivers 104 are formed along two sides of the TFT substrate 10 outside of the seal member 52. On the TFT substrate 10, wires 105 connecting the data driver 201, the scanning drivers 104, the external connection terminals 202, and vertical connection terminals 107 are provided along the edge sides of the TFT substrate 10.

The vertical connection terminals 107 are formed at four corners of the seal member 52 on the TFT substrate 10. Vertical connecting members 106 of which the lower ends are in contact with the vertical connection terminals 107 and of which the upper ends are in contact with the counter electrode 21 are provided between the TFT substrate 10 and the counter substrate 20, and the electrical connection between the TFT substrate 10 and the counter substrate 20 is accomplished by the vertical connecting members 106.

A driving circuit unit 60 of the electro-optical device according to the exemplary embodiment can include, as shown in FIG. 1, a controller 61 as writing-image generating means, a frame memory corresponding to two screens and having a first frame memory 62 and a second frame memory 63, and a DA converter 64, in addition to the data driver 201 and the scanning driver 104 included in the liquid crystal panel 1. On of the first frame memory 62 and the second frame memory 63 is used for temporarily storing an image of one frame input externally, the other is used for display, the functions thereof are exchanged in a unit of frames.

A vertical synchronizing signal Vsync, a horizontal synchronizing signal Hsync, a dot clock signal dotclk, and image signals DATA of an input image are input to the controller 61. The controller 61 controls the first frame memory 62 and the second frame memory 63, and reads out data to be written to the scanning lines from the frame memory.

The controller 61 can acquire image signals delayed by a predetermined time from the image signals externally input using the memories 62 and 63. For example, the controller 61 can acquire image signals advanced or delayed by a half a vertical period from the input image signals. In addition, the controller 61 can synchronize the image signals advanced and delayed by a half the vertical period, convert the synchronized image signals into signals having double a horizontal frequency of the input image, and rearrange and output the signal arrangement of the image signals in response to the scanning operation to be described below on the display area 101*a*.

The image signals from the controller 61 are applied to the DAC 64. The DAC 64 converts the digital image signals from the controller 61 into analog signals and supplies the analog signals to the data driver 201. The controller 61 generates various signals for driving the data driver 201 and the scanning driver 104. In order to generate various signals, the controller 61 can include a timing generator (not shown) as timing signal generating device. The timing generator generates various timing signals on the basis of the vertical synchronizing signal Vsync, the horizontal synchronizing signal Hsync, and the dot clock signal dotclk supplied externally.

In other words, the controller 61 generates a transmission clock CLX as a display driving signal using the timing generator, and outputs the transmission clock to the data driver 201. In addition, the controller 61 generates a scanning start pulse DY and transmission clocks CLY and $\overline{\text{CLY}}$, and outputs the signals to the scanning driver 104. In addition, the controller 61 generates enable si-gnals ENBY1 and ENBY2, and outputs the enable signals to the scanning driver 104.

In the exemplary embodiment, an independent clock is used as the transmission clock CLY. In this case, for the purpose of the accurate writing operation, the controller 61 generates various timing signals using the timing generator and defines the output timing of the image signals. Details of the timing generator will be described later.

The data driver 201 retains the image signals corresponding to the number of horizontal pixels using a sampling and holding circuit not shown. The transmission clock CLX is a clock signal for determining the sampling timing of the sampling and holding circuit corresponding to the respective data lines. The data driver 201 outputs the image signals retained in the sampling and holding circuit through the data lines.

The scanning start pulse DY generated from the controller 61 is a pulse signal for indicating the start of scanning, and in the present embodiment, the scanning start pulse is generated two times in one vertical period. For example, the controller 61 generates the scanning start pulse DY at a timing departed by a half the vertical period. In response to input of the scanning start pulse DY to the scanning driver 104, the scanning driver 104 outputs the scanning signals G1 to Gm (hereinafter, referred to as gate pulses) for turning on the TFT 30 of each pixel to the scanning lines G1 to Gm.

The transmission clocks CLY and $\overline{\text{CLY}}$ are signals for defining the scanning speed of the scanning side (Y side), and are pulses rising or falling correspondingly to one horizontal period of the input image signals. As described below, the scanning driver 104 shifts the scanning lines to which the gate pulses are output, in synchronism with the transmission clock CLY ($\overline{\text{CLY}}$).

In the exemplary embodiment, since two scanning start pulses DY are generated in one vertical period, in the display area 101*a*, the gate pulses are supplied to two scanning lines which are spaced from each other by the number of lines corresponding to the difference between two scanning start pulses in one horizontal period.

In this case, in order that the TFTs 30 connected to the two scanning lines are not simultaneously turned on to write the same image signal transmitted through the data lines to the pixel electrodes 9 connected to the two scanning lines, one horizontal period is divided into a first half and a second half, and the gate pulses are alternately supplied to the two scanning lines in the first half and the second half of one horizontal period.

The controller 61 rearranges the input image signals and the delayed signals thereof in accordance with the aforementioned scanning operation, inverts the polarities thereof every horizontal period, and supplies the inverted signals to the data driver 201. For example, the controller 61 acquires the writing image by alternately the input image signals and the delayed signals thereof every line. That is, the image signals of the writing image input to the data driver 201 are converted to the signals having double a transmission rate of the image signals of the input image input to the controller 61, and in the display panel 1, a so-called double-rate scanning operation of writing the same pixel signal to the pixel electrode 9 two times is performed.

That is, the horizontal period of the image signals input to the data driver 201 is a period h (=H/2) which is a half the horizontal period H of the original input image signals. The writing period (hereinafter, referred to as a horizontal writing period) for the pixels of one line in the display area 101*a* of the liquid crystal panel 1 is matched with the horizontal period of the writing image.

One horizontal period H includes two horizontal writing periods h, and the pixel signals corresponding to the images of the respective lines are supplied to the pixels of two lines in one horizontal writing period. The enable signals ENBY1 and ENBY2 are used to write pixel signals of the two lines in each of the two horizontal writing periods h.

Figure 5:
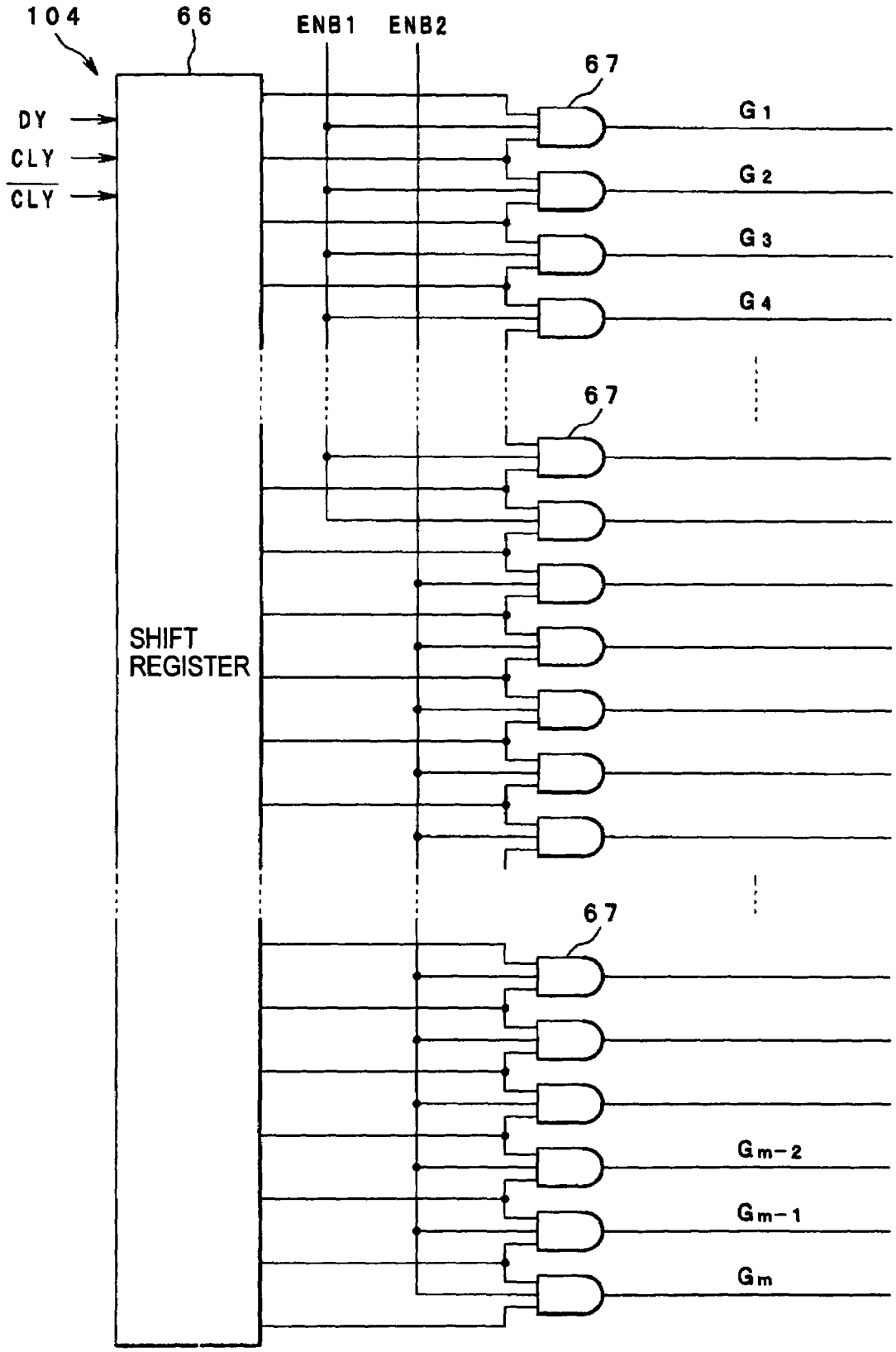
FIG. 5 is an exemplary circuit diagram illustrating a specific structure of a scanning driver 104 of FIG. 1.

Next, the scanning driver 104 will be described with reference to FIG. 5. As shown in FIG. 5, the scanning driver 104 comprises a shift register 66 to which the scanning start pulse DY, the clock signal CLY, and the inverted clock signal $\overline{\text{CLY}}$ from the controller 61, and m AND circuits 67 to which the output of the shift register 66 is input. The output terminals of the AND circuits 67 are connected to m scanning lines G1 to Gm, respectively.

Figure 6:
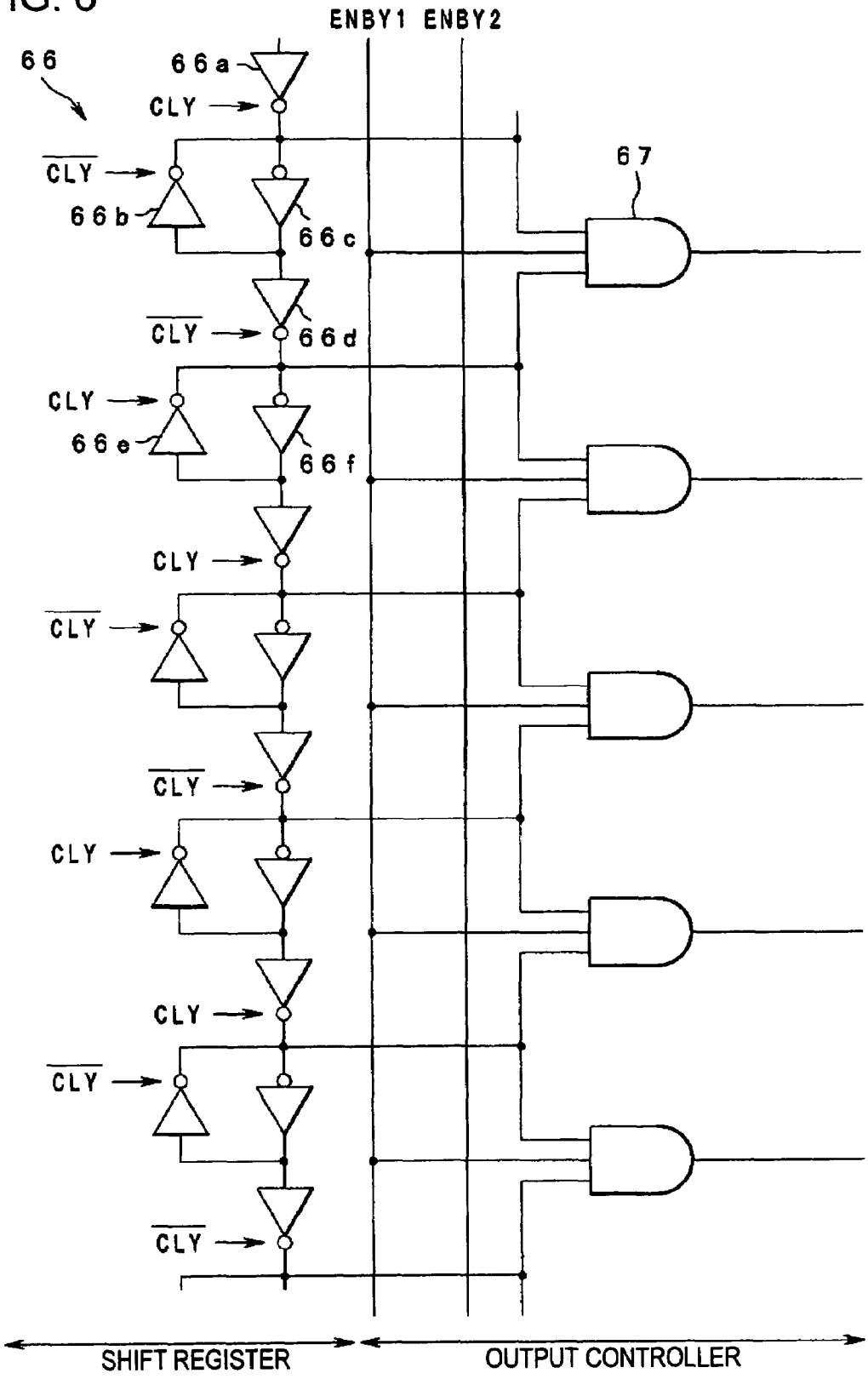
FIG. 6 is an exemplary circuit diagram specifically illustrating an important part of FIG. 5.

FIG. 6 shows a specific structure of the shift register 66. The scanning start pulse DY input to a clocked inverter 66*a* is a pulse having a predetermined width, and a pulse based on the scanning start pulse DY is sequentially transmitted to the respective AND circuits 67 through the clocked inverter 66*a*, an inverter 66*c*, a clocked inverter 66*d*, and an inverter 66*f*. By applying the output of the clocked inverter 66*b* to the AND circuit 67, the rising and falling of the output pulse of the AND circuit 67 is regulated by the clock signal CLY.

The enable signals ENBY1 and ENBY2 are also input to the AND circuits 67. For example, the enable signal ENBY1 is input to the AND circuits 67 corresponding to the odd scanning lines and the enable signal ENBY2 is input to the AND circuits 67 corresponding to the even scanning lines. The AND circuits 67 calculate a logical sum of three inputs and output the logical sum as the scanning signal to the respective scanning line. As a result, the pulse width of the gate pulse is matched with the pulse width of the enable signals ENBY1 and ENBY2, and the pulse width becomes the horizontal writing period.

Figure 7:
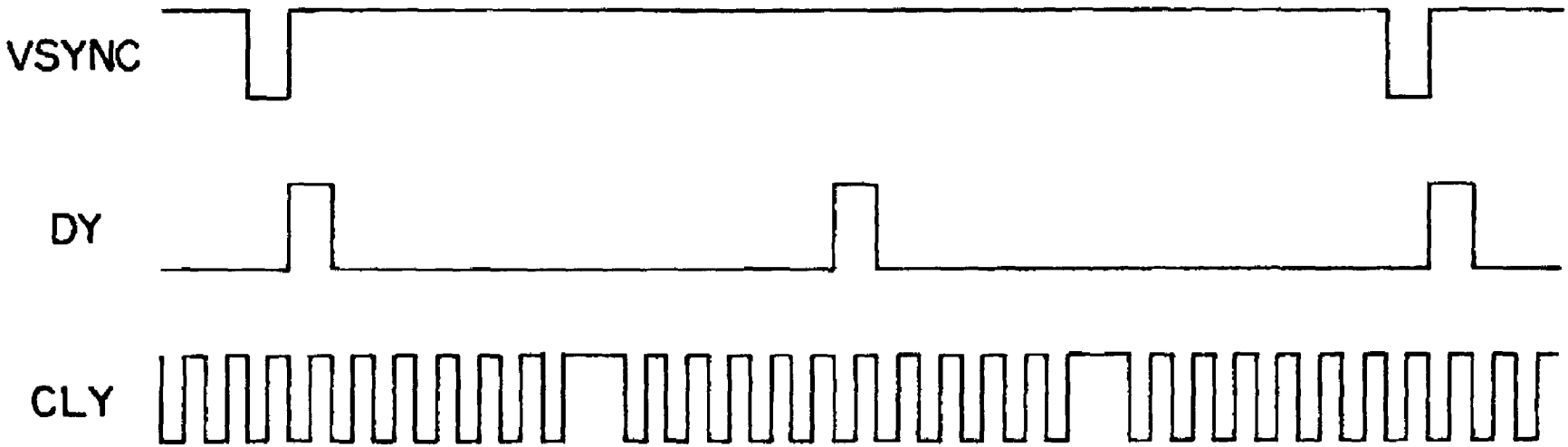
FIG. 7 is a timing chart illustrating operation of the electro-optical device.

Next, the operation of the driving circuit unit 60 will be described in detail with reference to FIGS. 7 and 8. As shown in FIG. 7, in the driving circuit unit 60, the scanning start pulse DY is output two times in one vertical period of the input image signals. The scanning start pulse DY is shifted in the shift register 66 of the scanning driver 104 by the clock signal CLY having a cycle of two horizontal periods in which one pulse rises or falls every horizontal period.

Since two scanning start pulses DY are generated in one vertical period, for example, the gate pulse of "H" generated from the AND circuit 67 of each scanning line on the basis of the first scanning start pulse DY is shifted to the next stage with a cycle of the horizontal period H of the input image signals, and the pulse width is defined as the "H" period of the enable signal ENBY1 or ENBY2. The gate pulse of "H" generated from the AND circuit 67 of each scanning line on the basis of the second scanning start pulse DY is shifted to the next stage with a cycle of the horizontal period H of the input image signals, and the pulse width thereof is defined as the "H" period of the enable signal ENBY1 or ENBY2.

By allowing ENBY1 and ENBY2 to sequentially rise, the gate pulse is alternately output to two positions spaced by m scanning lines from each other on a screen in one horizontal period H. In the next one horizontal period H, the gate pulse is generated for the next scanning lines, respectively. That is, the gate pulses are sequentially output in such a way that a scanning line spaced by m scanning lines from a predetermined scanning line is selected, a scanning line next to the predetermined scanning line is then selected, a scanning line spaced by m scanning lines from the selected scanning line is selected, and a scanning line next to the scanning line spaced by m scanning line from the above-selected scanning line is selected (that is, in the order of the scanning line G1, the scanning line (Gm/2)+1, the scanning line G2, the scanning line (Gm/2)+2, G3, . . . .

In this way, by utilizing the scanning start pulse DY and the enable signals ENBY1 and ENBY2, the operation can be performed in a state where the horizontal writing period of the liquid crystal panel 1 is set to approximately a half the horizontal period H of the input image signals.

Figure 9:
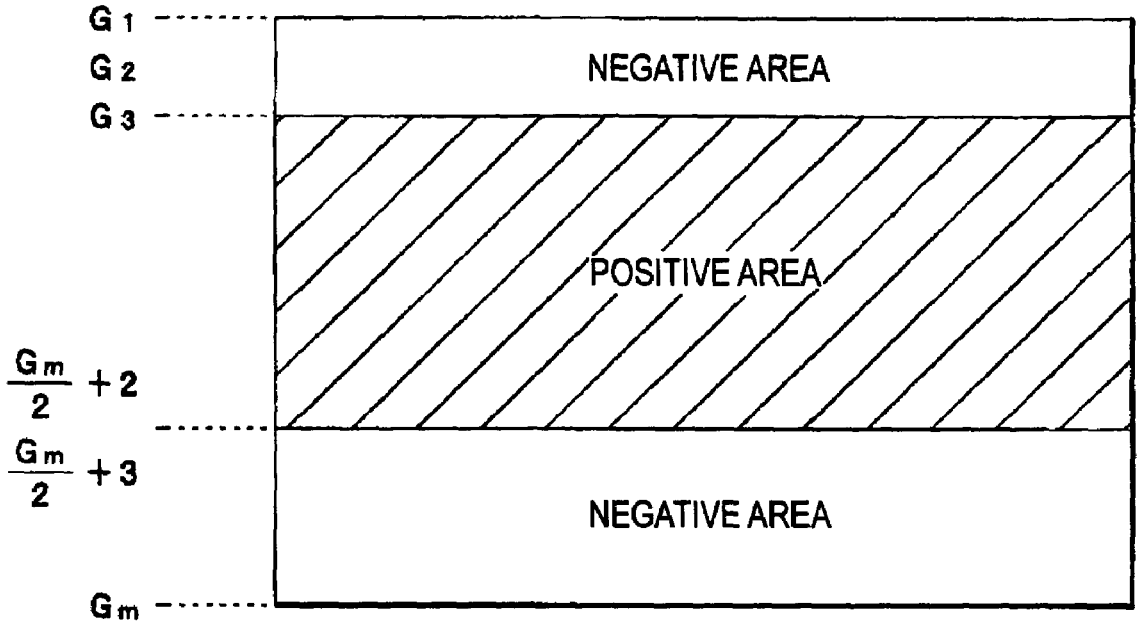
FIG. 9 is an explanatory diagram illustrating an image on a screen.

On the other hand, the data signals Sx output from the data driver 201 are polarity-inverted to a positive potential and a negative potential in a unit of one horizontal writing period about a common potential LCCOM. Therefore, while inverting the polarities of the data signals Sx in a unit of one horizontal writing period, the gate pulses are alternately output to two positions spaced by m scanning lines from each other in the aforementioned order. As a result, as shown in FIG. 9, noting any horizontal period, for example, the dots (pixels) corresponding to the scanning lines G3 to (Gm/2)+2 on the screen become an area (hereinafter, simply referred to as a positive area) to which data having a positive potential are written, and the dots (pixels) corresponding to the scanning lines G1 to G2 and (Gm/2)+3 to Gm on the screen become an area (hereinafter, simply referred to as a negative area) to which data having a negative potential are written. That is, the screen is divided into three areas of one positive area and two negative areas to which data having different polarities are written.

Figure 10:
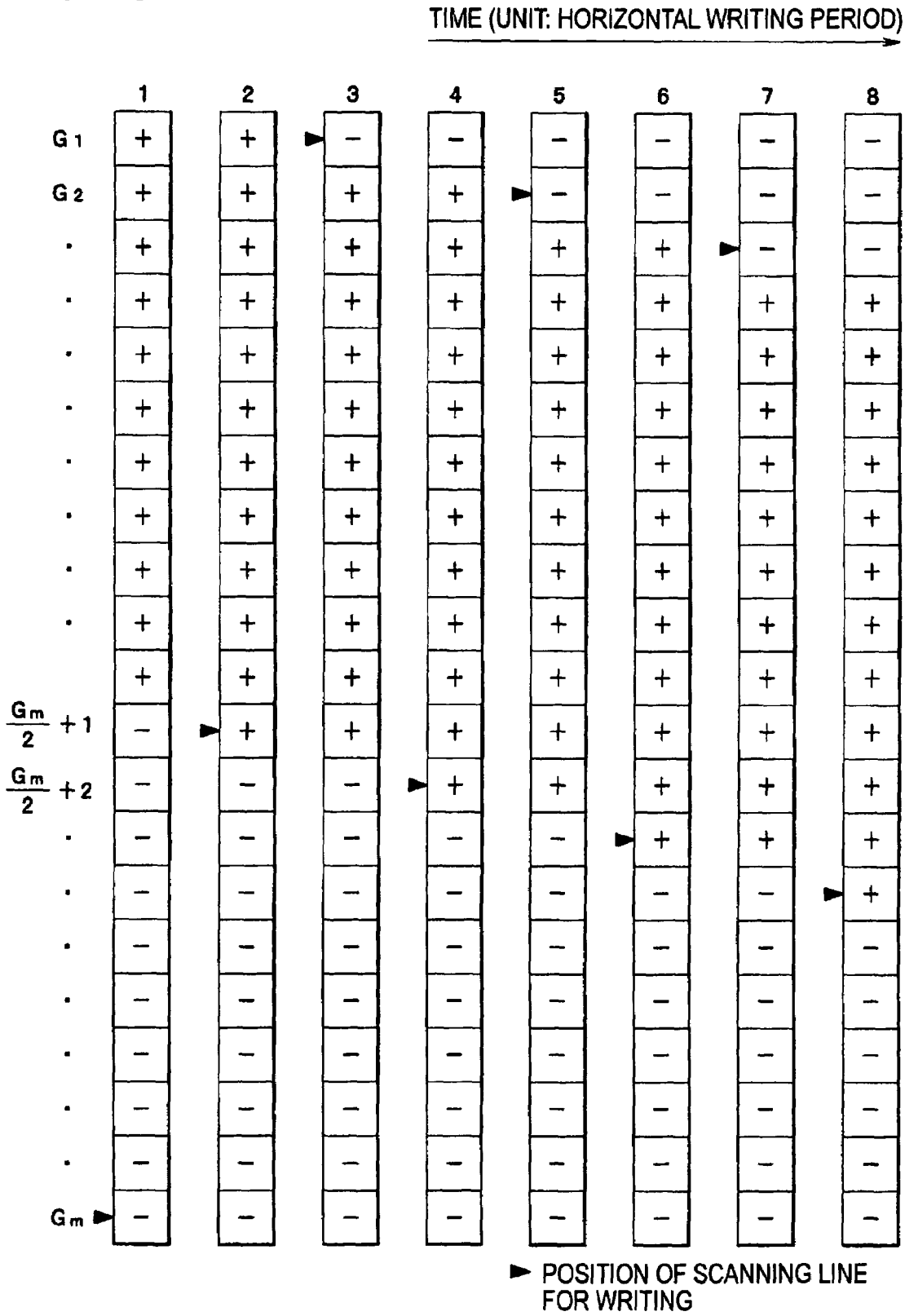
FIG. 10 is an explanatory diagram illustrating the writing (driving) operation on the screen.

FIG. 9 shows a screen as seen at one moment of one horizontal period and FIG. 10 shows a state of the screen where the polarities are changed with time. Assumed that the transverse axis of FIG. 10 denotes a time (unit: one horizontal writing period), a negative potential is written to the dot corresponding to the scanning line Gm in the first horizontal writing period, and in the second horizontal writing period, a positive potential is written to the dot corresponding to the scanning line (Gm/2)+1 to which a negative potential has been written in the first horizontal writing period. Then, in the third horizontal writing period, a negative potential is written to the dot corresponding to the scanning line G1 to which a positive potential has been written a half vertical period before.

Therefore, the positive area and the negative area are shifted by one line in a unit of one horizontal writing period h, and when the scanning lines are shifted by a half of the screen, the positive area and the negative area are completely inverted. That is, the rewriting of one screen is performed. The rewriting of one screen is performed during the half vertical period, and during one vertical period, the pixels are rewritten once more. That is, according to this method, when the scanning lines are shifted over the whole screen, the rewriting is performed two times.

As described above, in the image signals input to the data driver 201, the same image advanced or delayed by a predetermined time (½ vertical period in FIG. 10) is arranged with a double transmission rate, and consequently, the same image is written to the respective pixels of the liquid crystal panel 1 two times in one vertical period, thereby performing a so-called double rate scanning operation.

In this way, in the exemplary embodiment, since two writing operations are started with delay by a predetermined time in one vertical period, the gate pulses are supplied to two scanning lines in one horizontal period. In this case, by alternately supplying the gate pulses to the scanning lines in a unit of one horizontal writing period which is a half horizontal period using the enable signals, the writing operation to the pixels is performed. For example, the writing operation is performed two times to the pixels while delaying the same image signals by a half vertical period. That is, two scanning operations are performed to all the scanning lines while repeatedly skipping some (plural) scanning lines. As a result, at an arbitrary timing, a plurality of areas having the positive-potential applying area and the negative-potential applying area exists correspondingly to the respective fields in one screen. Hereinafter, this driving method is referred to as an area-scanning inversion driving method.

Figure 11A:
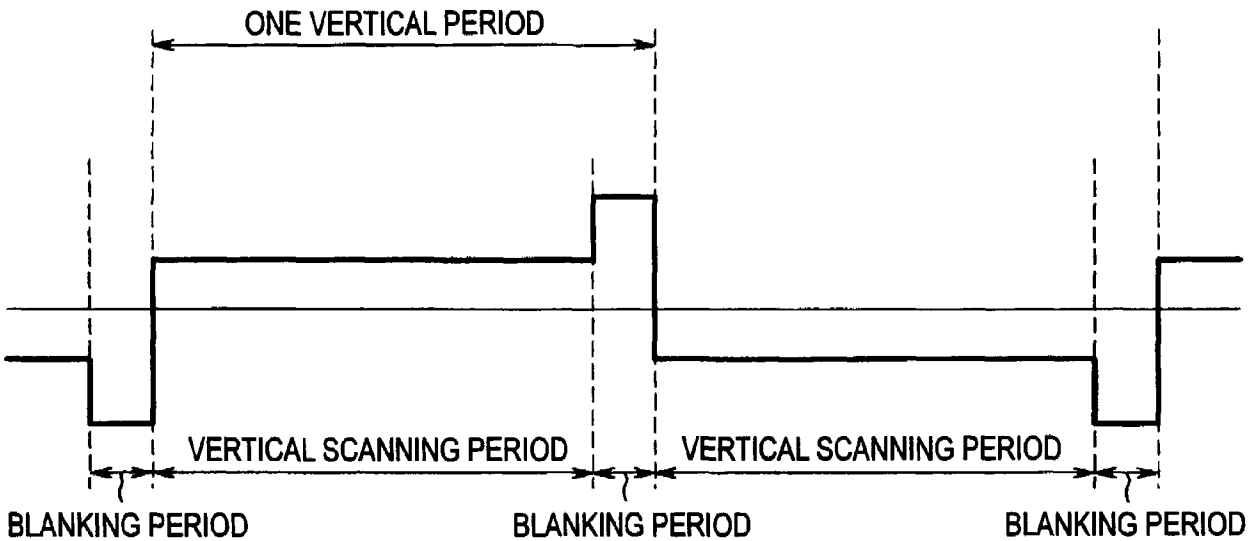
FIG. 11 is an explanatory diagram illustrating an image signal in a field inversion driving method of inverting the image signal in a unit of vertical period, which is an example of a surface inversion driving method.
Figure 11B:
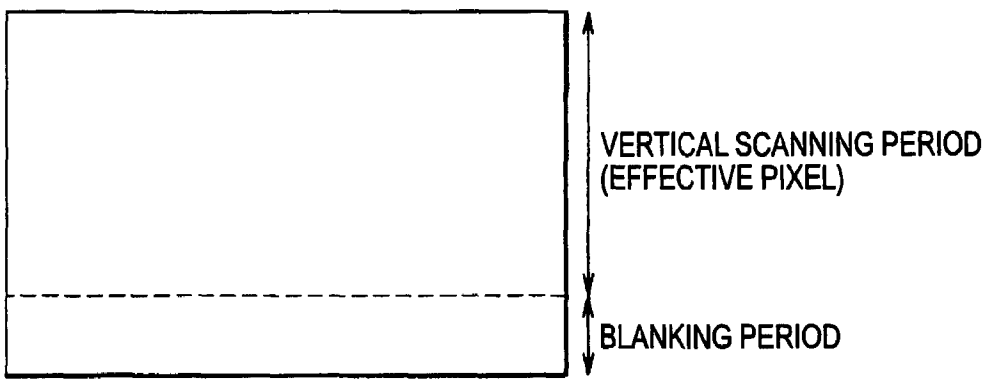

An image signal of one vertical period is illustrated in FIG. 11, where a conventional surface inversion driving method is exemplified. FIG. 11A shows a waveform of an image signal in two vertical periods, and FIG. 11B shows a relation between the image signal waveform and the position on the screen of FIG. 11A.

As shown in FIG. 11, in the surface inversion driving method, the polarity of the image signal is inverted in a unit of one vertical period. At the end of one vertical period, a blanking period is provided. In FIG. 11B, the area corresponding to the vertical scanning period is an area of the effective pixels. In general, preparation for display of a next field is performed in the blanking period.

That is, in the period (the blanking period) for inputting the vertical synchronizing signal, since the writing of an image is not performed, various signals (operations) are reset using the vertical synchronizing signal. For example, in response to input of the vertical synchronizing signal, the transmission clock CLY is prepared and the timing control is performed every vertical period.

Figure 12:
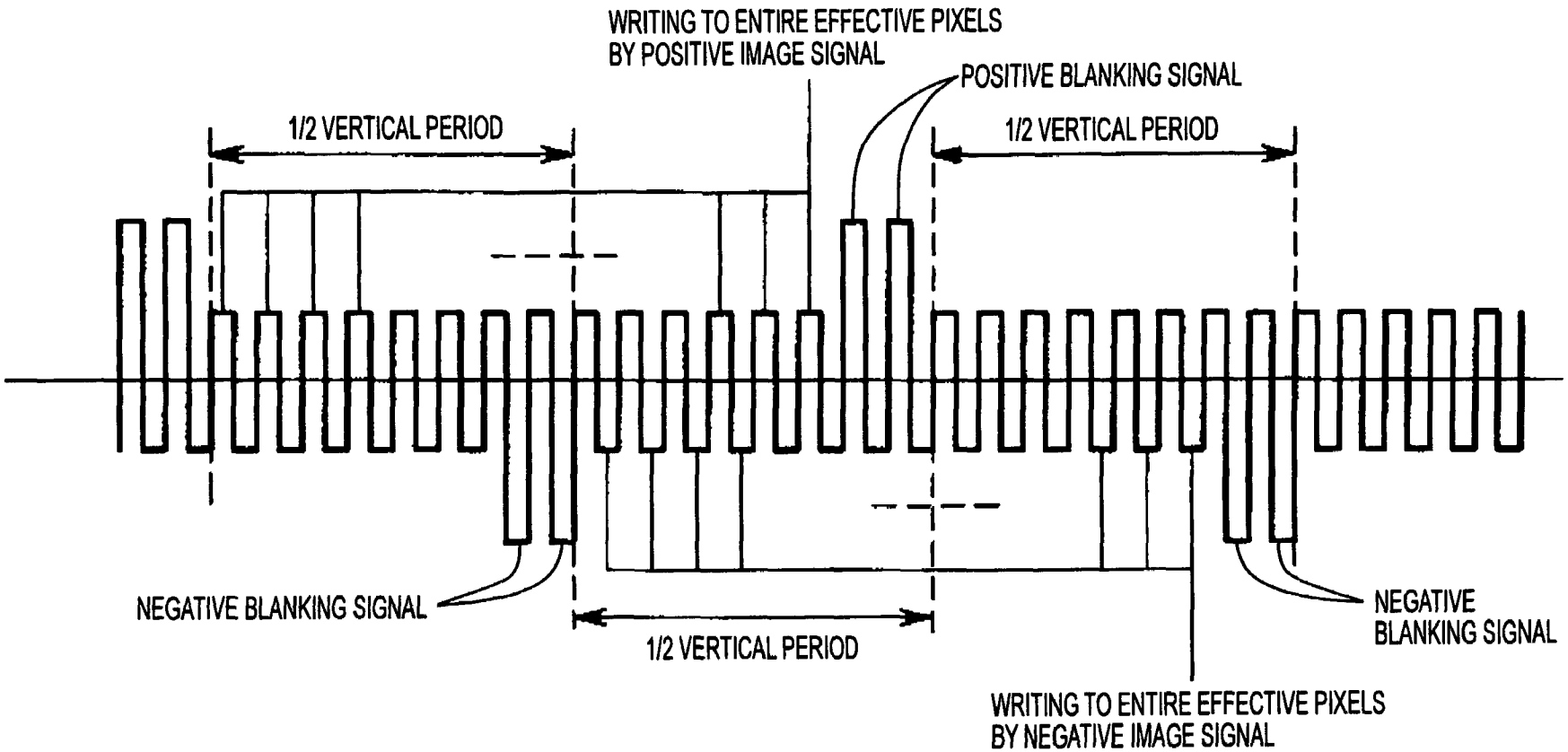
FIG. 12 is a waveform diagram illustrating an example of an image signal waveform used for an area scanning inversion driving method.

On the contrary, FIG. 12 illustrates an example of an image signal waveform used in the area-scanning inversion driving method described above. One pulse having a positive or negative polarity indicates one horizontal writing period, and the amplitude thereof indicates a level of the image signal. In FIG. 12, for the purpose of simplifying the figure, the number of pulses (the number of horizontal periods) in one vertical period is smaller than the number of pulses in an actual case.

The writing operation to the entire effective pixels and the preparation for the next writing operation are performed using the positive image signal of one vertical period including the blanking period, and the writing operation to the entire pixels and the preparation for the next writing operation are performed using the negative image signal of one vertical period including the blanking period. In this way, as described above, two writing operations using the same image is performed in one vertical period.

As described above, two scanning start pulses are generated in one vertical period, and the writing operation based on the first scanning start pulse DY and the writing operation based on the next scanning start pulse, as shown in FIG. 12, has the time difference of a half vertical period. For example, when the positive image signal is written based on the first scanning start pulse DY, the negative image signal is written based on the next scanning start pulse. As described above, the writing operations are performed in different horizontal writing periods, respectively.

Since the writing operation of the positive image signal and the writing operation of the negative image signal, of which the start timings are different by a half vertical period, are simultaneously performed with a time difference of a horizontal writing period, as shown in FIG. 12, the blanking period appears in a unit of a half vertical period, and in the blanking period a black level signal (blanking signal) having one polarity and the image signal having the other polarity are supplied to the adjacent pixels. That is, in the area-scanning inversion driving method, the writing operation of the image signal having the other polarity is performed in the blanking period of one polarity.

That is, in the area-scanning inversion driving method, the reset cannot be performed even in the period for inputting the vertical synchronizing signal. If the reset is performed, the writing operation is influenced, so that the scanning speed is varied or the writing pixels are changed.

Figure 13:
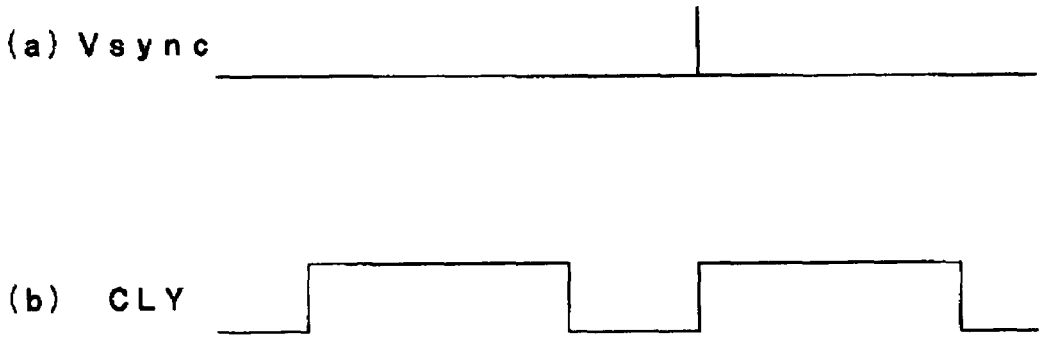
FIG. 13 is a timing chart explaining problems due to not performing a reset operation every vertical period.

An example where the number of horizontal periods in one vertical period is not integer is shown in FIG. 13. FIG. 13A shows the vertical synchronizing signal Vsync and FIG. 13B shows the transmission clock CLY synchronized with the input image signal.

For example, when the reset performed in synchronism with the vertical synchronizing signal input externally with an input image in which one vertical period includes 1280.5 horizontal periods, as shown in FIG. 13B, the transmission clock CLY right before the vertical synchronizing signal has a pulse width of 0.5 H, so that the transmission is not normally performed. As a result, such a problem that the image is disturbed occurs.

Figure 14:
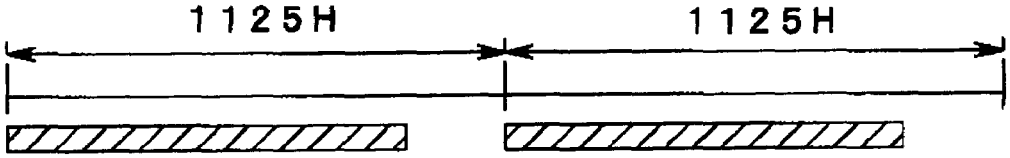
FIG. 14 is an explanatory diagram illustrating a problem when the number of horizontal scanning lines in one vertical period is odd.

FIG. 14 shows a case where the number of horizontal periods in one vertical period is odd. As shown in FIG. 8, the scanning driver 104 performs the transmission operation using the transmission clock CLY having a cycle of 2 H. Accordingly, when the number of horizontal periods is odd, the reset synchronized with the vertical synchronizing signal input externally causes the disturbance of the transmission clock CLY, and in this case, there also occurs a problem that the image disturbed.

Therefore, in the embodiment, by employing the transmission clock CLY being independent of the vertical synchronizing signal, various timing signals can be generated and the input timing of the writing image signals can be controlled, on the basis of the transmission clock CLY. The control operation is performed by the controller 61.

Figure 15:
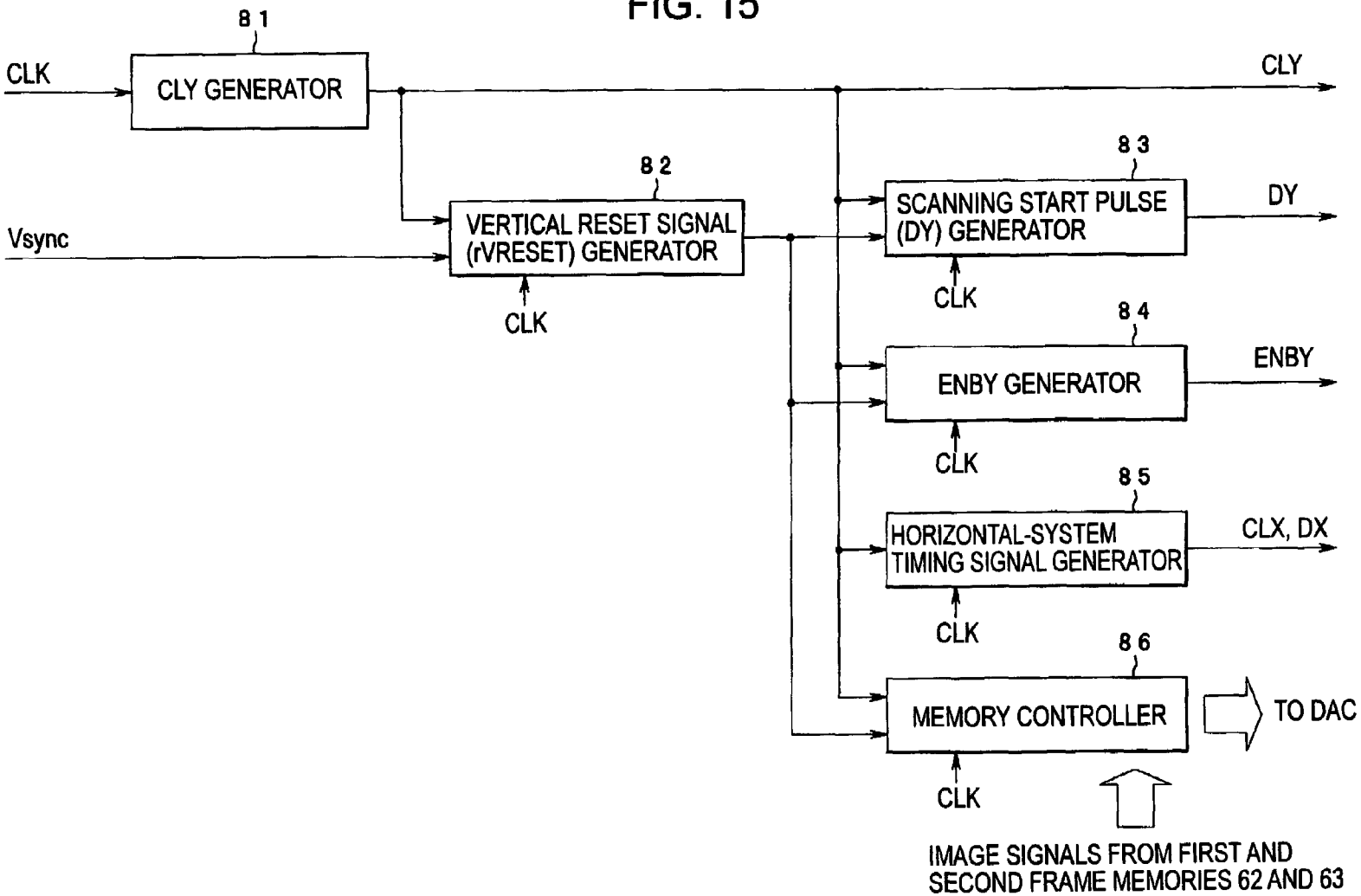
FIG. 15 is an exemplary block diagram illustrating a specific structure of a timing generator and a memory controller built in a controller 61 of FIG. 1.

FIG. 15 is an exemplary block diagram illustrating a specific structure of a timing generator and a memory controller built in the controller 61 of FIG. 1. The vertical synchronizing signal Vsync extracted from the input image signal and the dot clock CLK generated from the controller 61 are input to the timing generator shown in FIG. 15. The clock CLK is input to the CLY generator 81. In the present embodiment, the CLY generator 8 generates the transmission clock CLY having a frequency of a half horizontal frequency of the input image signal on the basis of the input clock CLK. That is, the transmission clock CLY is an independent clock and cannot be said to be in synchronism with the vertical synchronizing signal. The transmission clock CLY generated from the CLY generator 81 is supplied to the scanning driver 104.

The transmission clock CLY generated from the CLY generator 81 is a basis of various timing signals, and the transmission clock CLY is output to the vertical reset signal (rVRESET) generator 82, the scanning start pulse (DY) generator 83, the ENBY generator 84, a horizontal-system timing signal generator 85, and the memory controller 86.

The vertical reset signal generator 82 is also supplied with the vertical synchronizing signal Vsync of the input image signal and the clock CLK, and generates the vertical reset signal rVRESET at the timing of the transmission clock CLY generated in close proximity of the vertical synchronizing signal Vsync. The vertical reset signal rVRESET is supplied to the scanning start pulse generator 83, the ENBY generator 84, the horizontal-system timing signal generator 85, and the memory controller 86.

The scanning start pulse generator 83 generates the scanning start pulse DY which is generated two times in one vertical period. For example, the scanning start pulse generator 83 generates the scanning start pulse DY in synchronism with the vertical reset signal rVRESET, and generates the scanning start pulse DY at the timing delayed by a predetermined number of horizontal periods from the first scanning start pulse DY in one vertical period, by counting the transmission clock CLY. The scanning start pulse DY from the scanning start pulse generator 83 is supplied to the scanning driver 104. The ENBY generator 84 generates the enable signals ENBY1 and ENBY2 which are generated two times in one horizontal period H, and supplies the enable signals to the scanning driver 104.

Figure 8:
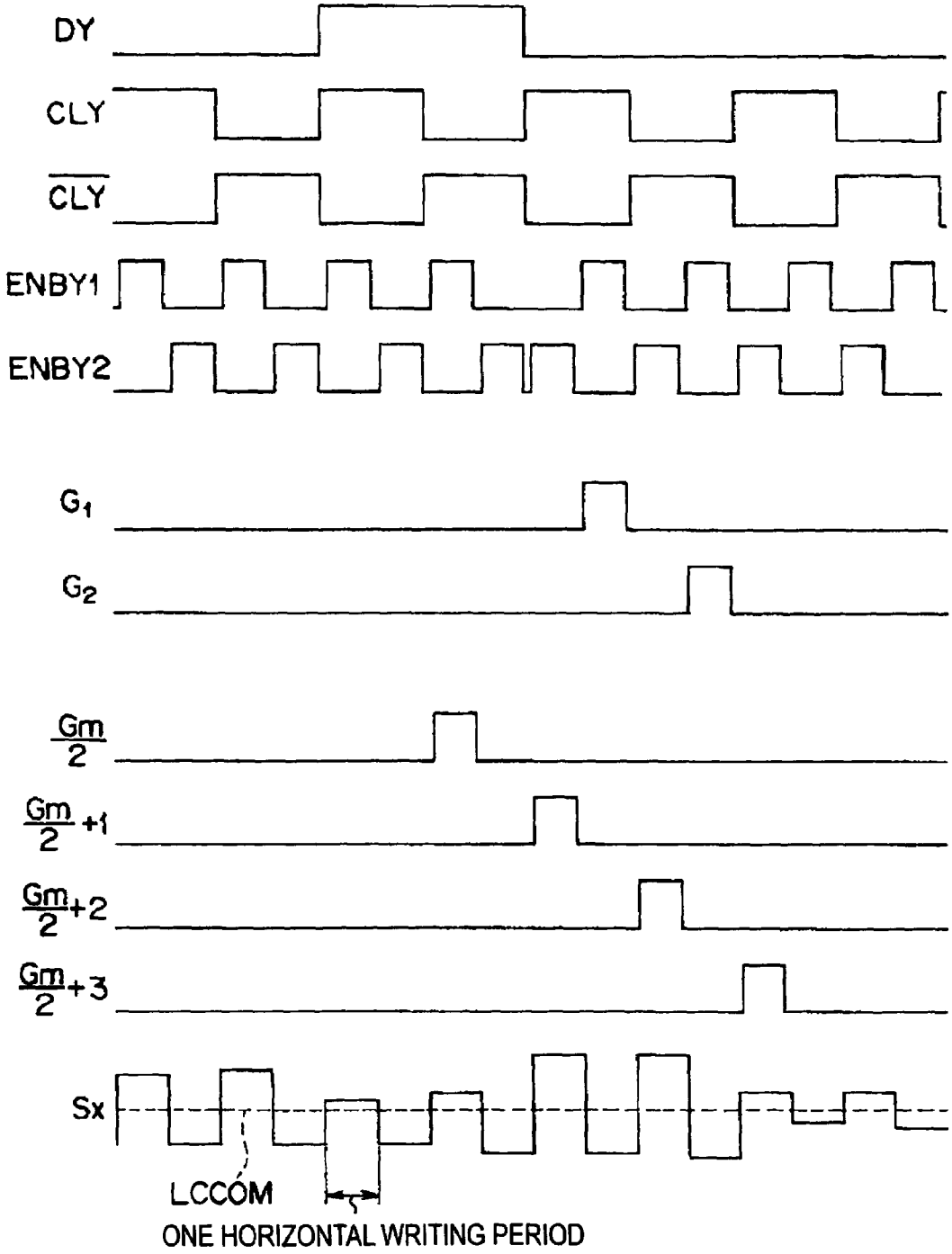
FIG. 8 is a timing chart extracting and illustrating an important part of FIG. 7.

The transmission clock CLY from the CLY generator 81, the scanning start pulse DY from the scanning start pulse generator 83, and the enable signals ENBY1 and ENBY2 from the ENBY generator 84 are synchronized with each other, and the vertical-system scanning operation shown in FIG. 8 can be performed using the timing signals.

The horizontal-system timing signal generator 85 generates a transmission clock CLX and a scanning start pulse DX of the horizontal scanning system on the basis of the transmission clock CLY. The horizontal and vertical scanning systems can be synchronized with the transmission clock CLY using the scanning start pulse generator 83, the ENBY generator 84, and the horizontal-system timing signal generator 85.

On the other hand, it is necessary to synchronize the writing image with the transmission clock CLY. The memory controller 86 of the controller 61 controls the reading-out operation of the image signals from the first and second frame memory 62 and 63 on the basis of the clock CLK, the transmission clock CLY, and the vertical reset signal rVRESET. For example, the memory controller 86 delays the image signals of the writing image by the time difference between the vertical synchronizing signal Vsync of the input image signals and the transmission clock CLY. As a result, the timing of the image signals of the writing image can be matched with the timing of the horizontal and vertical scanning systems.

Figure 16:
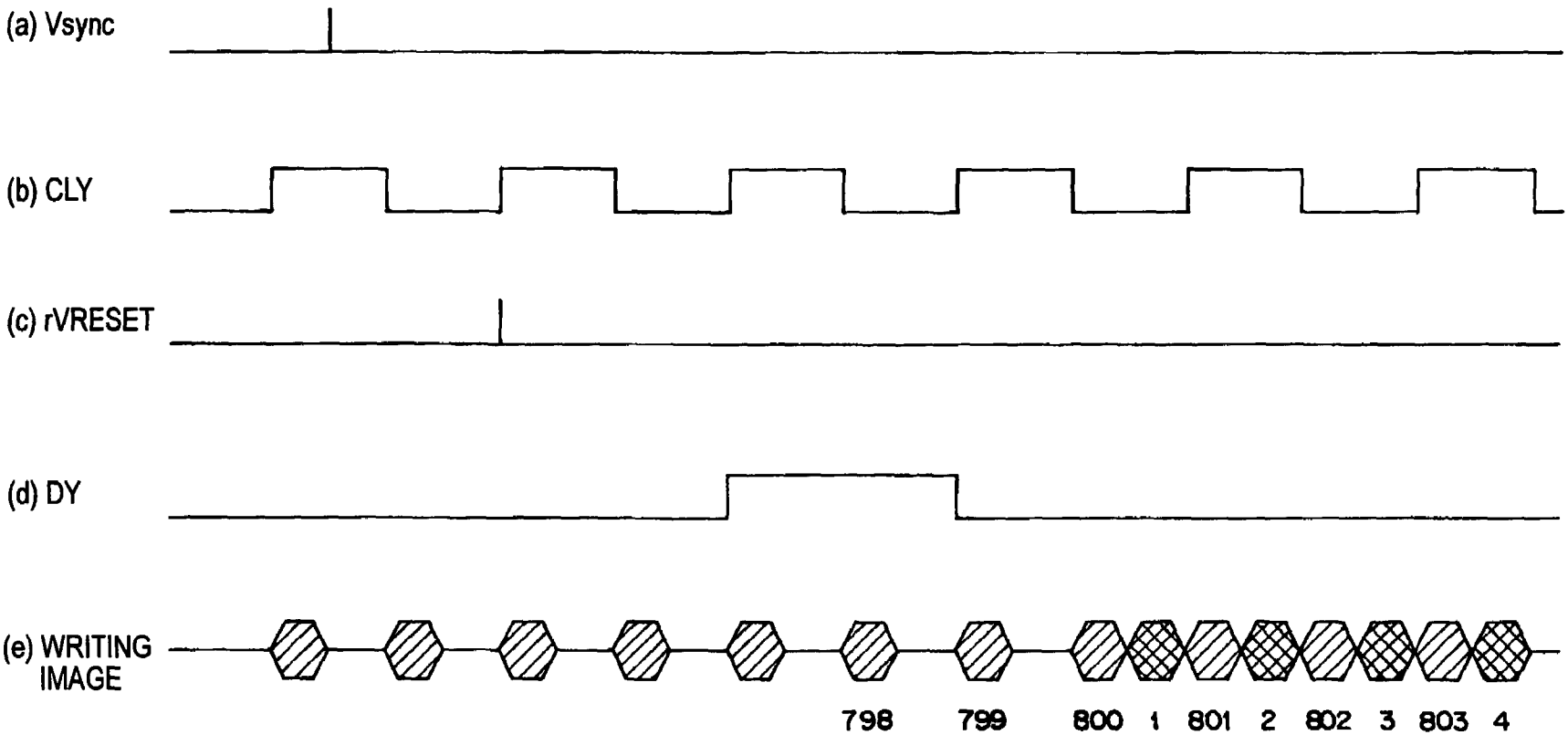
FIG. 16 is a timing chart illustrating operations of the timing generator and the memory controller 86.

Next, operations of the timing generator and the memory controller 86 will be described with reference to FIG. 16. FIG. 16(*a*) shows the vertical synchronizing signal Vsync of the input signal, FIG. 16(*b*) shows the transmission clock CLY from the CLY generator 81, FIG. 16(*c*) shows the vertical reset signal rVRESET from the vertical reset signal generator 82, FIG. 16(*d*) shows the scanning start pulse DY from the scanning start pulse generator 83, and FIG. 16(*e*) shows the image signal of the writing image from the memory controller 86. In FIG. 16(*e*), the number of the scanning lines is indicated by the numbers below the hatched portions and the latticed portions, and an example where the writing start timings between the positive writing image signals (hatched portions) and the negative writing image signals (latticed portions) are delayed by the time corresponding to 800 pixels is shown.

FIG. 16(*a*) shows the vertical synchronizing signal Vsync of the input image signal. On the other hand, the CLY generator 81 generates the transmission clock CLY having a half horizontal frequency of the input image signal on the basis of the input clock CLK. As shown in FIGS. 16(*a*) and 16(*b*), the transmission clock CLY is not synchronized with the vertical synchronizing signal Vsync of the input image signal. In the exemplary embodiment, the transmission clock CLY is independently generated, and a process of changing the cycle so as to synchronizing the transmission clock CLY with the vertical synchronizing signal Vsync of the input image signal is not performed. The transmission clock CLY may be generated on the basis of the horizontal synchronizing signal of the input image signal.

As shown in FIG. 16(*c*), the vertical reset signal generator 82 generates the vertical reset signal rVRESET at the timing of the transmission clock CLY in close proximity of the input vertical synchronizing signal Vsync. That is, the vertical synchronizing signal Vsync of the input image signal is re-timed by the transmission clock CLY independently generated at the inside of the device.

The scanning start pulse generator 83 generates the scanning start pulse DY using the transmission clock CLY and the vertical reset signal rVRESET re-timed by the transmission clock CLY. For example, the scanning start pulse generator 83 generates the scanning start pulse DY in synchronism with the rising timing of the first transmission clock CLY after input of the vertical reset signal rVRESET (FIG. 16(*d*)). In this way, the scanning operation is performed in synchronism with the transmission clock CLY.

On the other hand, the memory controller 86 matches the phase of the writing image with the transmission clock CLY by controlling the reading-out operation from the first and second frame memories 62 and 63 using the transmission clock CLY and the vertical reset signal rVRESET re-timed by the transmission clock CLY. That is, as shown in FIG. 16(*e*), the memory controller 86 performs the reading-out operation of the pixel signals of the first line in one vertical period, correspondingly to the timing of the enable signals ENBY1 and ENBY2 (see FIG. 8) generated from the first transmission clock CLY after input of the scanning start pulse DY synchronized with the transmission clock CLY. In this way, the writing image signal synchronized with the transmission clock CLY is obtained.

In FIG. 16(*e*), the writing operation of the positive image signal (hatched portions) is performed in a unit of one horizontal period H on the basis of a scanning start pulse DY right before the scanning start pulse DY shown in FIG. 16(*d*), and the writing operation of the negative image signal indicated by the latticed portions is started with the scanning start pulse DY on the basis of the vertical reset signal rVRESET shown in FIG. 16(*c*), so that the writing operation of the positive and negative writing image signals is performed in a unit of one horizontal writing period (approximately a half horizontal period).

In this way, the vertical reset signal rVRESET is generated in synchronism with the transmission clock CLY, and the scanning start pulse DY, which controls the start of the writing operation (the start of the vertical scanning operation) of the positive and negative writing image signals, is generated in synchronism with the vertical reset signal rVRESET and the transmission clock CLY. That is, the start timing of the positive writing image signal and the start timing of the negative writing image signal are not subjected to the reset operation by the vertical synchronizing signal Vsync of the input image but are synchronized with the transmission clock CLY. Since the transmission clock CLY is always independently generated at a constant cycle, the gate pulses are continuously generated at a constant interval before and after the start timing of the vertical period, so that no problem occurs in FIGS. 13 and 14.

In this way, in the embodiment, the positive area and the negative area having a half area of a screen, respectively, are inverted in a unit of one vertical period, and the surface inversion driving is performed in each area. In one vertical period, two dots adjacent to each other have antipolar potentials only in one horizontal writing period and have a homopolar potential in most the other time, so that the disclination little occurs. On the other hand, as indicated by the signal waveform Sn in FIG. 8, the signals having the same polarity as that of the conventional line inversion driving method are transmitted to the data lines S1, S2, . . . , and similarly to the conventional surface inversion driving method, a large difference in temporal potential relation between the pixel electrodes and the data lines does not occur in the upper pixels and the lower pixels on a screen, so that it is possible to prevent irregularity in display depending upon positions of the screen while preventing the crosstalk.

Since the vertical synchronizing signal of the input image is re-timed by the independent transmission clock CLY and the positioning of the vertical scanning-system timing signals and the writing image is performed using the re-timed vertical synchronizing signal as the vertical reset signal, it is possible to prevent the disturbance of the transmission clock CLY before and after the start timing of the vertical period. As a result, even when the number of horizontal periods in one vertical period to be input is not an integer, or even when an odd number of scanning lines is provided, it is possible to prevent disadvantages such as the insufficient writing time or the disturbance of an image.

Figure 17:
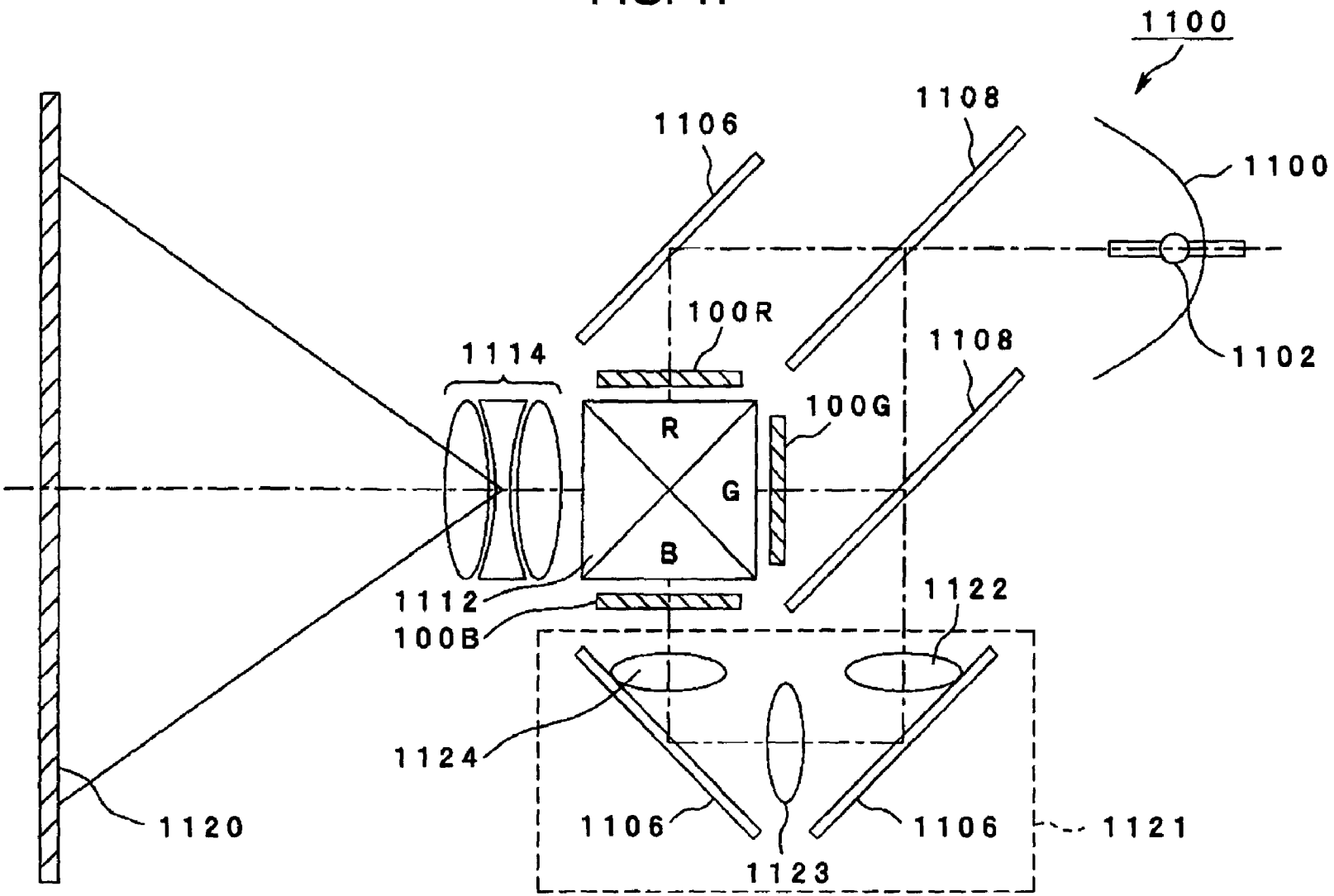
FIG. 17 is a structural diagram schematically illustrating an example of a so-called three-plate transmissive liquid crystal display apparatus (liquid crystal projector) employing three liquid crystal light valves according to the exemplary embodiment.

FIG. 17 is a structural diagram schematically illustrating an example of a so-called three-plate transmissive liquid crystal display apparatus (liquid crystal projector) employing three liquid crystal light valves according to the aforementioned embodiments. In the figure, reference numeral 1100 denotes a light source, reference numeral 1108 denotes a dichroic mirror, reference numeral 1106 denotes a reflecting mirror, reference numerals 1122, 1123, and 1124 denote relay lenses, reference numerals 100R, 100G, and 100B denote liquid crystal light valves, reference numeral 1112 denotes a cross dichroic prism, and reference numeral 1114 denotes a projection lens system.

The light source 1100 can include a lamp 1102, such as a metal halide lamp, etc. and a reflector 1101 reflecting light of the lamp 1102. The dichroic mirror 1108 for reflecting blue and green light components transmits a red light component of the white light from the light source 1100 and reflects the blue light component and the green light component. The transmitted red light component is reflected by the reflecting mirror 1106 and is input to the red liquid crystal light valve 100R.

On the other hand, among the light components reflected by the dichroic mirror 1108, the green light component is reflected by the dichroic mirror 1108 for reflecting the green light component and is input to the green liquid crystal light valve 100G. On the other hand, the blue light component passes through the second dichroic mirror 1108. In order to compensate for the optical path of the blue light component different from that of the green and red light components, light guiding means 1121 having the relay lens system including an incident lens 1122, a relay lens 1123, and an output lens 1124 is provided, and the blue light component is input to the blue liquid crystal light valve 100B through the relay lens system.

Three light components modulated by the light valves 100R, 100G, and 100B are input to the cross dichroic prism 1112. In the prism, four rectangular prisms are coupled and a dielectric multilayer film reflecting the red light component and a dielectric multilayer film reflecting the blue light component are formed in a cruciate shape on the inner surface thereof. Three light components are synthesized by the dielectric multilayer films, thereby forming light indicating a color image. The synthesized light is projected onto a screen 1120 through the projection lens system 1114 which is a projection optical system, and thus an image is enlarged and displayed.

Since the projection liquid crystal display apparatus having the above structure employs the liquid crystal light valves according to the above embodiments, it is possible to realize a projection liquid crystal display apparatus having uniform display quality.

It should be understood that the technical scope of the invention is not limited to the exemplary embodiments described above, but various modifications may be made therein without departing from the spirit and scope of the invention. For example, although it has been exemplified in the above embodiments that a screen is divided into two areas to which different polar potentials are written, the number of divided areas is not limited to this, but the number of divided areas may be increased. However, as the number of divided areas increases, the time where the antipolar potential is being applied to the adjacent scanning lines is lengthened. In this case, it is preferable that the homopolar potential is applied at a time ratio of 50% or more in at least one vertical period. The scanning order in the areas is not limited to the embodiments and may be properly changed.

The electro-optical device according to the invention may be applied to an active matrix liquid crystal panel (for example, a liquid crystal display panel having TFT (Thin Film Transistors) or TFD (Thin Film Diodes) as switching elements), as well as a passive matrix liquid crystal display panel. In addition to the liquid crystal display panel, the present invention may be similarly applied to various electro-optical devices such as an electroluminescence device, an organic electroluminescence device, a plasma display device, an electrophoresis display device, a device employing electron emission (such as a field emission display (FED) device, a surface-conduction electron-emitter display device, etc.), a digital light processing (DPL) device (also referred to as a digital micro mirror device (DMD)), and the like.

While this invention has been described in conjunction with the specific embodiments thereof, it is evident that many alternatives, modifications, and variations will be apparent to those skilled in the art. Accordingly, preferred embodiments of the invention as set forth herein are intended to be illustrative, not limiting. There are changes that may be made without departing from the spirit and scope of the invention.

What is claimed is:

1. A driving circuit of an electro-optical device, the electro-optical device, comprising:

pixels formed corresponding to respective intersections between a plurality of data lines and a plurality of scanning lines to constitute a display unit;

switching elements which are turned on by scanning signals supplied to the scanning lines and which are provided in the pixels; and pixel electrodes in the pixels to which image signals supplied to the data lines are applied through the switching elements when the switching elements are turned on, the driving circuit, comprising:

a transmission clock generator that generates a transmission clock for sequentially transmitting the scanning signals to the scanning lines in synchronism with a signal having a frequency equal to a horizontal frequency of input image signals and outputting the transmission clock as a timing signal;

a vertical reset signal generator that generates a vertical reset signal synchronized with the transmission clock generated in close proximity of a vertical synchronizing signal of the input image signals;

a scanning start pulse generator that generates a scanning start pulse defining a start timing of a vertical scanning operation on the basis of the transmission clock and the vertical reset signal and outputting the scanning start pulse as a timing signal; and a writing image generator that generates writing image signals to be supplied to the data lines by delaying the input image signals on the basis of the transmission clock and the vertical reset signal.

2. An electro-optical device, comprising:

the driving circuit of an electro-optical device according to claim 1;

a scanning drive circuit that generates the scanning signals on the basis of the outputs of the transmission clock generator and the scanning start pulse generator;

a data drive circuit that supplies the writing image signals from the writing image generator to the data lines; and the display unit.

3. An electro-optical device, comprising:

pixels formed corresponding to respective intersections between a plurality of data lines and a plurality of scanning lines to constitute a display unit;

switching elements which are turned on by scanning signals supplied to the scanning lines and which are provided in the pixels;

pixel electrodes in the pixels to which image signals supplied to the data lines are applied through the switching elements when the switching elements are turned on;

a scanning drive circuit that selects n scanning lines (n is an integer greater than or equal to 2) spaced from each other to sequentially supply gate pulses to the selected scanning lines in one horizontal period of an input image corresponding to the number of pixels in the display unit and that shifts the selected n scanning lines by one line in a next horizontal period;

a timing signal generator that generates a transmission clock synchronized with a signal having a frequency equal to a horizontal frequency of the input image, retimes a vertical synchronizing signal of the input image on the basis of the generates transmission signal to generate a vertical reset signal, and generating timing signals for generating the scanning signals on the basis of the vertical reset signal and the transmission clock to apply the timing signals to the scanning drive circuit;

a writing image generator that synthesizes image signals of the input image and delayed signal thereof, arranges the synthesized image having a horizontal frequency, which is n times the horizontal frequency of the input image, in a signal arrangement corresponding to the scanning operation of the scanning drive circuit, and delays the arranged synthesized image on the basis of the vertical reset signal and the transmission clock to generate a writing image; and a data drive circuit to which image signals of the writing image from the writing image generator are input and which inverts the polarity of the image signals in a unit of a horizontal writing period, which is 1/n times the horizontal period of the input image to supply the inverted image signals to the data lines.

4. The electro-optical device according to claim 3, the timing signal generator, further comprising:

a transmission clock generator that generates a transmission clock for sequentially transmitting the scanning signals to the scanning lines in synchronism with a signal having a frequency equal to a horizontal frequency of input image signals and outputting the transmission clock as the timing signal;

a vertical reset signal generator that generates a vertical reset signal synchronized with the transmission clock generated in close proximity of a vertical synchronizing signal of the input image signals; and a scanning start pulse generator that generates a scanning start pulse defining a start timing of a vertical scanning operation on the basis of the transmission clock and the vertical reset signal and outputting the scanning start pulse as a timing signal.

5. The electro-optical device according to claim 3, the transmission clock being generated on the basis of a dot clock.

6. A driving method of an electro-optical device, the electro-optical device comprising:

pixels formed corresponding to respective intersections between a plurality of data lines and a plurality of scanning lines to constitute a display unit;

switching elements which are turned on by scanning signals supplied to the scanning lines and which are provided in the pixels; and pixel electrodes in the pixels to which image signals supplied to the data lines are applied through the switching elements when the switching elements are turned on, the method comprising:

driving for the display unit by selecting n scanning lines (n is an integer greater than or equal to 2) spaced from each other to sequentially supply gate pulses to the selected scanning lines in one horizontal period of an input image corresponding to the number of pixels in the display unit and shifting the selected n scanning lines by one line in a next horizontal period;

generating a transmission clock synchronized with a signal having a frequency equal to a horizontal frequency of the input image, re-timing a vertical synchronizing signal of the input image on the basis of the generated transmission signal to generate a vertical reset signal, and generating timing signals for generating the scanning signals on the basis of the vertical reset signal and the transmission clock;

synthesizing image signals of the input image and delayed signal thereof, arranging the synthesized image having a horizontal frequency, which is n times the horizontal frequency of the input image, in a signal arrangement corresponding to the scanning operation in the scan driving process, and delaying the arranged synthesized image on the basis of the vertical reset signal and the transmission clock to generate a writing image; and receiving image signals of the writing image obtained from the writing image generating process and inverting the polarity of the image signals in a unit of a horizontal writing period, which is 1/n times the horizontal period of the input image to supply the inverted image signals to the data lines.

7. An electronic apparatus comprising the electro-optical device according to claim 3.

8. A driving circuit of an electro-optical device, the electro-optical device, comprising:

pixels formed corresponding to respective intersections between a plurality of data lines and a plurality of scanning lines to constitute a display unit;

switching elements which are turned on by scanning signals supplied to the scanning lines and which are provided in the pixels; and pixel electrodes in the pixels to which image signals supplied to the data lines are applied through the switching elements when the switching elements are turned on, the driving circuit, comprising:

a transmission clock generating device that generates a transmission clock for sequentially transmitting the scanning signals to the scanning lines in synchronism with a signal having a frequency equal to a horizontal frequency of input image signals and outputting the transmission clock as a timing signal;

a vertical reset signal generating device that generates a vertical reset signal synchronized with the transmission clock generated in close proximity of a vertical synchronizing signal of the input image signals;

scanning start pulse generating device that generates a scanning start pulse defining a start timing of a vertical scanning operation on the basis of the transmission clock and the vertical reset signal and outputting the scanning start pulse as a timing signal; and a writing image generating device that generates writing image signals to be supplied to the data lines by delaying the input image signals on the basis of the transmission clock and the vertical reset signal.

9. An electro-optical device, comprising:

pixels formed corresponding to respective intersections between a plurality of data lines and a plurality of scanning lines to constitute a display unit;

switching elements which are turned on by scanning signals supplied to the scanning lines and which are provided in the pixels;

pixel electrodes in the pixels to which image signals supplied to the data lines are applied through the switching elements when the switching elements are turned on;

a scanning drive device that selects n scanning lines (n is an integer greater than or equal to 2) spaced from each other to sequentially supply gate pulses to the selected scanning lines in one horizontal period of an input image corresponding to the number of pixels in the display unit and shifting the selected n scanning lines by one line in a next horizontal period;

a timing signal generating device that generates a transmission clock synchronized with a signal having a frequency equal to a horizontal frequency of the input image, re-times a vertical synchronizing signal of the input image on the basis of the generated transmission signal to generate a vertical reset signal, and generates timing signals for generating the scanning signals on the basis of the vertical reset signal and the transmission clock to apply the timing signals to the scanning drive circuit;

a writing image generating device that synthesizes image signals of the input image and delayed signal thereof, arranges the synthesized image having a horizontal frequency, which is n times the horizontal frequency of the input image, in a signal arrangement corresponding to the scanning operation of the scanning drive device, and delays the arranged synthesized image on the basis of the vertical reset signal and the transmission clock to generate a writing image; and a data drive device that receives image signals of the writing image from the writing image generating means are input and inverting the polarity of the image signals in a unit of a horizontal writing period, which is 1/n times the horizontal period of the input image to supply the inverted image signals to the data lines.

* * * * *